US011505886B2

(12) United States Patent
Padgett et al.

(10) Patent No.: US 11,505,886 B2
(45) Date of Patent: Nov. 22, 2022

(54) VARIABLE OR MULTI-GAUGE TUFTING WITH COLOR PLACEMENT AND PATTERN SCALING

(71) Applicant: Tuftco Corporation, Chattanooga, TN (US)

(72) Inventors: Robert A. Padgett, Chattanooga, TN (US); Jason Daniel Detty, Chattanooga, TN (US); Paul E. Beatty, Chattanooga, TN (US); Jeffrey D. Smith, Chattanooga, TN (US); Steven L. Frost, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 16/927,686

(22) PCT Filed: Jan. 13, 2019

(86) PCT No.: PCT/US2019/013412

§ 371 (c)(1),
(2) Date: Jul. 13, 2020

(87) PCT Pub. No.: WO2019/140349

PCT Pub. Date: Jul. 18, 2019

(65) Prior Publication Data

US 2020/0407902 A1 Dec. 31, 2020

Related U.S. Application Data

(60) Provisional application No. 62/617,178, filed on Jan. 13, 2018.

(51) Int. Cl.

| | |
|---|---|
| ***D05C 15/28*** | (2006.01) |
| ***D05C 15/10*** | (2006.01) |
| ***D05C 15/30*** | (2006.01) |

(52) U.S. Cl.

CPC ..... *D05C 15/28* (2013.01); *D05C 15/10* (2013.01); *D05C 15/30* (2013.01)

(58) Field of Classification Search

CPC ..... D05C 15/10; D05C 15/26; D05C 15/28; D05C 15/30

See application file for complete search history.

(56) References Cited

U.S. PATENT DOCUMENTS

| | | | | |
|---|---|---|---|---|
| 5,461,996 | A * | 10/1995 | Kaju | D05C 15/26 112/475.19 |
| 2002/0043202 | A1* | 4/2002 | Freeman | D04H 18/02 112/80.23 |
| 2007/0283863 | A1* | 12/2007 | Ingram | D05C 15/14 112/80.4 |
| 2009/0205547 | A1* | 8/2009 | Hall | D05C 15/36 112/80.41 |
| 2016/0298275 | A1* | 10/2016 | Hall | D05C 15/30 |
| 2017/0096757 | A1* | 4/2017 | Hall | D05C 15/28 |
| 2017/0204546 | A1* | 7/2017 | Padgett | D05C 15/26 |

* cited by examiner

*Primary Examiner* — Nathan E Durham
(74) *Attorney, Agent, or Firm* — Miller & Martin PLLC

(57) ABSTRACT

A shiftable backing feed or shiftable needle assembly is utilized with a tufting machine having reciprocating needles and gauge parts for seizing or cutting yarns wherein yarn placement patterns can be utilized to tuft at different gauge densities while maintaining the same pattern sizes and appearance.

17 Claims, 22 Drawing Sheets

| | Showing Designed Gauge 1/2" For 4" Design | | | | | | | |
|---|---|---|---|---|---|---|---|---|
| Needle | 0 | 1 | 2 | 3 | 4 | 5 | 6 | 7 |
| Gauge 0.5 | 0 | 0.5 | 1 | 1.5 | 2 | 2.5 | 3 | 3.5 |

| | Showing Scaled Design for 1/4" Gauge Sewing For 4" Design | | | | | | | | | | | | | | | |
|---|---|---|---|---|---|---|---|---|---|---|---|---|---|---|---|---|
| Needle | 0 | 1 | 2 | 3 | 4 | 5 | 6 | 7 | 8 | 9 | 10 | 11 | 12 | 13 | 14 | 15 |
| Gauge 0.25 | 0 | 0.25 | 0.50 | 0.75 | 1 | 1.25 | 1.5 | 1.75 | 2 | 2.25 | 2.5 | 2.75 | 3 | 3.25 | 3.5 | 3.75 |

*FIG. 17*

VARIABLE OR MULTI-GAUGE TUFTING WITH COLOR PLACEMENT AND PATTERN SCALING

The present invention claims priority to PCT Application PCT/US2019/013412 filed Jan. 13, 2019 and U.S. Provisional Application Ser. No. 62/617,178 filed Jan. 13, 2018.

FIELD OF THE INVENTION

This invention relates to tufting machines and more particularly to a method pattern rescaling adaptable for converting yarn placement or yarn placement while shifting the backing fabric during tufting in a fashion that can allow for increasing (or decreasing) the density of the pile fabric produced, and further to providing patterning effects and streak break-up in the resulting tufted fabrics.

BACKGROUND OF THE INVENTION

In the production of tufted fabrics, a plurality of spaced yarn carrying needles extend transversely across the machine and are reciprocated cyclically to penetrate and insert pile into a backing material fed longitudinally beneath the needles. During each penetration of the backing material a row of pile is produced transversely across the backing. Successive penetrations result in longitudinal columns of pile tufts produced by each needle. This basic method of tufting limits the aesthetic appearance of tufted fabrics. Thus, the prior art has developed various procedures for initiating relative lateral movement between the backing material and the needles in order to laterally displace longitudinal rows of stitching and thereby create various pattern effects, to conceal and display selected yarns, to break up the unattractive alignment of the longitudinal rows of tufts, and to reduce the effects of streaking which results from variations in coloration of the yarn.

The tufting industry has long sought easy and efficient methods of producing new visual patterns on tufted fabrics. In particular, the industry has sought to tuft multiple colors so that any selected yarns of multiple colors could be made to appear in any desired location on the fabric. Significant progress toward the goal of creating carpets and tufted fabrics selectively displaying one of a plurality of yarns came with the introduction of a servo motor driven yard feed attachments. Notable among these attachments are the servo scroll attachment described in Morgante, U.S. Pat. No. 6,224,203 and related patents; the single end servo scroll of Morgante, U.S. Pat. No. 6,439,141 and related patents; and the double end servo scroll of Frost, U.S. Pat. No. 6,550,407.

In operation the servo scroll yarn feed attachment, when alternating needles are threaded with A and B yarns respectively, allows the control of tufting of heights of yarns so that at a given location on the surface of the tufted fabric, either or both of the A and B yarns may be visible. However, a servo scroll yarn feed carries several yarns on each servo driven yarn feed roll so that the pattern must repeat several times across the width of the fabric and a yarn tube bank must be used to distribute the yarns. The implementation of the single end scroll pattern attachment, and the similar double end servo scroll pattern attachment, permitted the tufting machine to be configured with A and B yarns fed to alternating needles on a front needle bar while C and D yarns were fed to alternating needles on a rear needle bar in order to create color representations on tufted fabrics. The single end scroll yarn feed could create patterns that extended across the entire width of the backing fabric. However, in the full color application described above, these efforts suffered from the difficulty that if a solid area of one color was to be displayed, only one of every four stitches was tufted to substantial height and the remaining three colors were "buried" by tufting the corresponding yarn bights to an extremely low height. With only one of four stitches emerging to substantial height above the backing fabric without compensating by slowing the backing fabric feed, the resulting tufted fabric had inadequate face yarn for general acceptance and in any case excessive yarn was "wasted" on the back of the greige.

The principal alternative to these servo yarn drive configurations has been the use of a pneumatic system to direct one of a plurality of yarns through a hollow needle on each penetration of the backing fabric, as typified by U.S. Pat. No. 4,549,496. Such hollow needle, pneumatic tufting machines were traditionally most suitable for producing cut pile tufted fabrics and have been subject to limitations involving the sizes of fabrics that can be tufted, the production speed for those fabrics, and the maintenance of the tufting machines due to the mechanical complexity attendant to the machines' operation. Accordingly, the tufting industry has had a long felt need for a tufting machine that could operate efficiently to display one of several yarns at a selected location while maintaining a suitable density of face yarns and an output of tufted fabrics at speeds approaching those of conventional tufting machines.

It should be noted that the pneumatic tufting machines utilizing hollow needles as in U.S. Pat. No. 4,549,496 generally tuft laterally for between about one-half to four inches before backing fabric is advanced, or alternatively the backing fabric is advanced at a gradual rate as described in U.S. Pat. No. 5,267,520. Because the yarn being tufted is cut at least every time the color yarn tufted through a particular needle is changed, there is no unnecessary yarn placed as back stitches on the bottom of the tufted fabric. However, when attempts have been made to utilize a regular tufting machine configuration with a needle bar carrying a transverse row of needles in a similar fashion, the yarns are not selected for tufting and cut after tufting, but instead each yarn is tufted in every reciprocal cycle of the needle bar. Therefore yarn carrying needles all penetrate the backing fabric on every cycle. The yarns are selected for display by a yarn pattern device feeding the yarn to be displayed and backrobbing the yarns that are not to be visible thereby burying the resulting yarn bights or tufts very close to the surface of the backing fabric. If several reciprocations are made as the needle bar moves laterally with respect to the backing fabric, then back stitch yarn for each of the colors of yarn is carried for each reciprocation and this results in considerable "waste" of yarn on the bottom of the resulting tufted fabric or greige. Independently Controlled Needle (ICN) tufting machines typified by Kaju, U.S. Pat. No. 5,392,723 and related patents, operate similarly, except the selection of the needles for tufting determines the yarns that will be displayed.

To overcome these difficulties, three methods of configuring and operating tufting machines of conventional design have been devised for the placement of color yarns.

In a first alternative, a pile fabric can be created selectively displaying one of three or more distinct yarns in the following fashion. Using the example of a thread-up featuring four yarns that have distinct colors, an inline needle bar, typically of about 1/10th gauge is threaded with a repeat of A, B, C, D over every four needles. The tufting machine is programmed to tuft four stitches laterally before advancing the backing fabric, or while advancing the backing fabric at about one-fourth the customary distance between reciprocations of the needle bar. In this fashion, each of the four adjacent needles threaded with yarns A, B, C, and D respectively will penetrate the backing fabric at nearly the same position. On those four cycles of the needles penetrating the backing fabric, adequate yarn will be fed by the associated servo motor for the color that is desired to predominate visually in that location. Sufficient yarn is fed to allow the yarn bight of the desired color to be tufted at a relatively high level. The other yarns are backrobbed in order to bury their associated yarn bights at a relatively low level. After tufting the four lateral cycles, the backing fabric has advanced by a distance approximately equal to the gauge of the needle bar and the four lateral reciprocation sequence is repeated with the needle bar moving in the opposite direction. It can be seen that this method, although functional, results in excess yarn on the bottom of the tufted fabric compared to ordinary tufted fabrics, and for a four-color thread-up requires that the tufting machine operate only at about one-fourth the speed that it would operate if tufting conventional fabric designs. This technique was described in U.S. Pat. No. 8,141,505 to Hall, and will be discussed in further detail below.

In a second alternative it is possible to create a similar color placement effect in a cut/loop pile fabric utilizing the level cut loop configuration of U.S. Pat. No. 7,222,576 tufted on a tufting machine having about a 1/10th gauge needle bar with a four color repeating thread-up. The tufting machine is operated to tuft laterally four times while advancing the backing only about one fourth of the gauge distance on each reciprocation of the needle bar. A yarn color chosen for display may be either a cut or loop bight while the yarn colors not to be shown on the face of the carpet are backrobbed, leaving only very low tufts of those yarns. Obviously, three or more than four different yarns may be used in the thread-up with a corresponding adjustment in the number of lateral shifts and the rate of backing fabric advance. In this method of operation, there is again considerable excess yarn carried on the bottom of the backing fabric.

Both the first and second alternatives are essentially the same techniques that have been utilized with two colors of yarn on a widespread basis in the tufting industry in past years. Although multiple cycles of lateral shifting presents some issues not present when shifting only a single lateral step, the principal issue is one of avoiding over-tufting or sewing exactly in the same puncture of the backing fabric made by a previous cycle of a nearby needle. This is typically addressed by using one or both of positive stitch placement and continuous, but reduced speed, backing fabric feed.

An additional problem presented by the first and second alternative techniques is the sheer number of penetrations of the backing fabric which results in degradation or slicing of nonwoven backing fabric materials that may be utilized in the manufacture of tufted fabrics for carpet tiles and special applications such as automotive carpets.

Finally, to overcome these shortcomings, a third alternative to produce similar fabrics with yarn placement has been achieved with a staggered needle configuration having front and rear rows of needles offset or staggered from one another. A staggered needle bar typically consists of two rows of needles extending transversely across the tufting machine. The rows of needles are generally spaced with a 0.25 inch offset in the longitudinal direction and are staggered so that the needles in the rear transverse row are longitudinally spaced between the needles in the front transverse row. Alternatively, two sliding needle bars each carrying a single transverse row of needles may be configured in a staggered alignment. Particularly when two sliding needle bars are used, the longitudinal offset between the rows of needles may be greater than 0.25 inches, and often about 0.50 inches.

In operation the needle bar is reciprocated so that the needles penetrate and insert loops of yarn in a backing material fed longitudinally beneath the needles. The loops of yarn are seized by loopers or hooks moving in timed relationship with the needles beneath the fabric. In most tufting machines with two rows of needles, there are front loopers which cooperate with the front needles and rear loopers which cooperate with the rear needles. In a loop pile machine, it may be possible to have two separate rows of loopers such as those illustrated in U.S. Pat. No. 4,841,886 where loopers in the front hook bar cooperate with the front needles and loopers in the rear hook bar cooperate with rear needles. Similar looper constructions have been used in tufting machines with separate independently shiftable front and rear needle bars, so that there are specifically designated front loopers to cooperate with front needles and specifically designated rear loopers to cooperate with rear needles. To achieve maximum density of needle penetrations, and to minimize the possibility of tufting front and rear needles through the same penetrations of the backing fabric, it is desirable to stagger the front loopers from the rear loopers by a half gauge unit.

The result of having loopers co-operable with only a given row of needles on a gauge tufting machine with two independently shiftable needle bars is that it is only possible to move a particular needle laterally by a multiple of the gauge of the needles on the relevant needle bar. Thus, for a fairly common 0.20 inch ($1/5^{th}$) gauge row of needles with corresponding loopers set at 0.20 inch gauge, the needles must be shifted in increments of 0.20 inches. This is so even though in a staggered needle bar with two longitudinally offset rows of 0.20 inch gauge needles the composite gauge of the staggered needle bar is 0.10 inch gauge. The necessity of shifting the rows of needles twice the gauge of the composite needle assembly results in patterns with less definition than could be obtained if it were possible to shift in increments of the composite gauge.

One effort to reduce the gauge of tufting has been to use smaller and more precise parts. Furthermore, in order to overcome the problem of double gauge shifting, U.S. Pat. No. 5,224,434 teaches a tufting machine with front loopers spaced equal to the composite gauge and rear loopers spaced equal to the composite gauge. Thus on a tufting machine with two rows of 0.20 inch gauge needles there would be a row of front loopers spaced at 0.10 inch gauge and a row of rear loopers spaced at 0.10 inch gauge. Although this allows the shifting of each row of needles in increments equal to the composite gauge, this solution was limited in by difficulties in creating cut and loop pile tufts from both the front needles and the rear needles.

Taking the arrangement of staggered needle bars shiftable at a composite gauge, and threading front needles with A and B yarns and rear needles with C and D yarns to form a repeat, a high volume of tufted fabric with selectively placed colored yarns can be manufactured with minimal wasted yarn used in the back stitching. This is because it is only necessary to shift each row of needles by a single lateral step in order to place all four A, B, C and D yarns in the desired location as described in U.S. Pat. No. 8,240,263.

In current tufting, most backing shifting has been directed to tufting machines that have needles capable of supplying one of several yarns with such needles spaced apart from one another by a half-inch or more. Typical of such machines are those described in U.S. Pat. Nos. 4,254,718; 5,165,352; 5,588,383; and 6,273,011, and embodied in commercial tufting machines sold by Tapistron, or in the later iTron tufting machines from Tuftco.

The backing shifters in these tufting machines of the type that select from one of several yarns to tuft are different from conventional broadloom tufting machines. Conventional broadloom tufting machines usually have needle plates placed below the needles with yarn being fed downward through openings in the eyes of the needles and then reciprocated between fingers or openings in the needle plates. In a broadloom loop pile machine, the loopers are positioned below the needle plate. The backing goes over the top of the needle plates with needle plate fingers being used to support the backing when it is pushed downward by the penetration load of the yarn carrying needles. The penetration load is substantial because the needles are usually spaced between ¼ and 1/12 inch apart, and because yarns carried by the needles may drag on the backing as the yarns are carried through the backing to be seized by the loopers or other gauge parts.

Since the loops on conventional broadloom tufting machines are continuous as they are formed on the base below the backing, it is not possible to effectuate an efficient backing shift in the needle area because of the needle plate location with needle plate fingers between columns of pile tufts. Attempting to shift the backing to any substantial degree, even a single gauge unit of the needle bar, causes the tufted face yarns to interfere with the needle plate fingers. Accordingly, in such a tufting machine, there have been attempts to use a pin roll positioned at a distance permitting tangential engagement of the backing layer, approximately two or three inches from the needle location, to move the backing a considerable distance to achieve a smaller movement of the fabric at the needle. Due to both the location of the pin rolls and the natural drag which is encountered because loops are positioned between needle plate fingers in proximity of the tufting zone it has not been possible to efficiently and precisely shift backing.

Co-owned U.S. Ser. No. 15/721,906 [PCT/US2017/054683], which is incorporated herein in its entirety, is directed to a backing shifter for use on broadloom tufting machine that is able to operate in a fashion that permits the shifting of the backing fabric relative to the needles and gauge parts without undo interference and thereby permits shifting not simply in gauge increments, but in a fashion that allows the creation of variable gauge and novel fabrics. This allows the tufting machine to create patterns similar to those created on a number of different tufting machines and it can be utilized to provide additional capacity for many desired product lines in the event of the need for extra capacity.

SUMMARY OF THE INVENTION

Accordingly, it is desired to combine the variable gauge tufting of U.S. Ser. No. 15/721,906 [PCT/US2017/054683] on traditional tufting practices with the yarn placement techniques of U.S. Pat. Nos. 8,141,505; 8,240,263; 9,556,548; 9,663,885 and their related families of patents and pattern resealing methods as described below. This combination allows for the more efficient and varied production of patterned textiles from a single tufting machine.

BRIEF DESCRIPTION OF THE DRAWINGS

Particular features and advantages of the present invention will become apparent from the following description when considered in conjunction with the accompanying drawings in which:

FIG. 17 illustrates the scaling of a design from half gauge to quarter gauge where the optical appearance of the design is changed.

DETAILED DESCRIPTION OF THE ILLUSTRATED EMBODIMENTS

Figure 1:
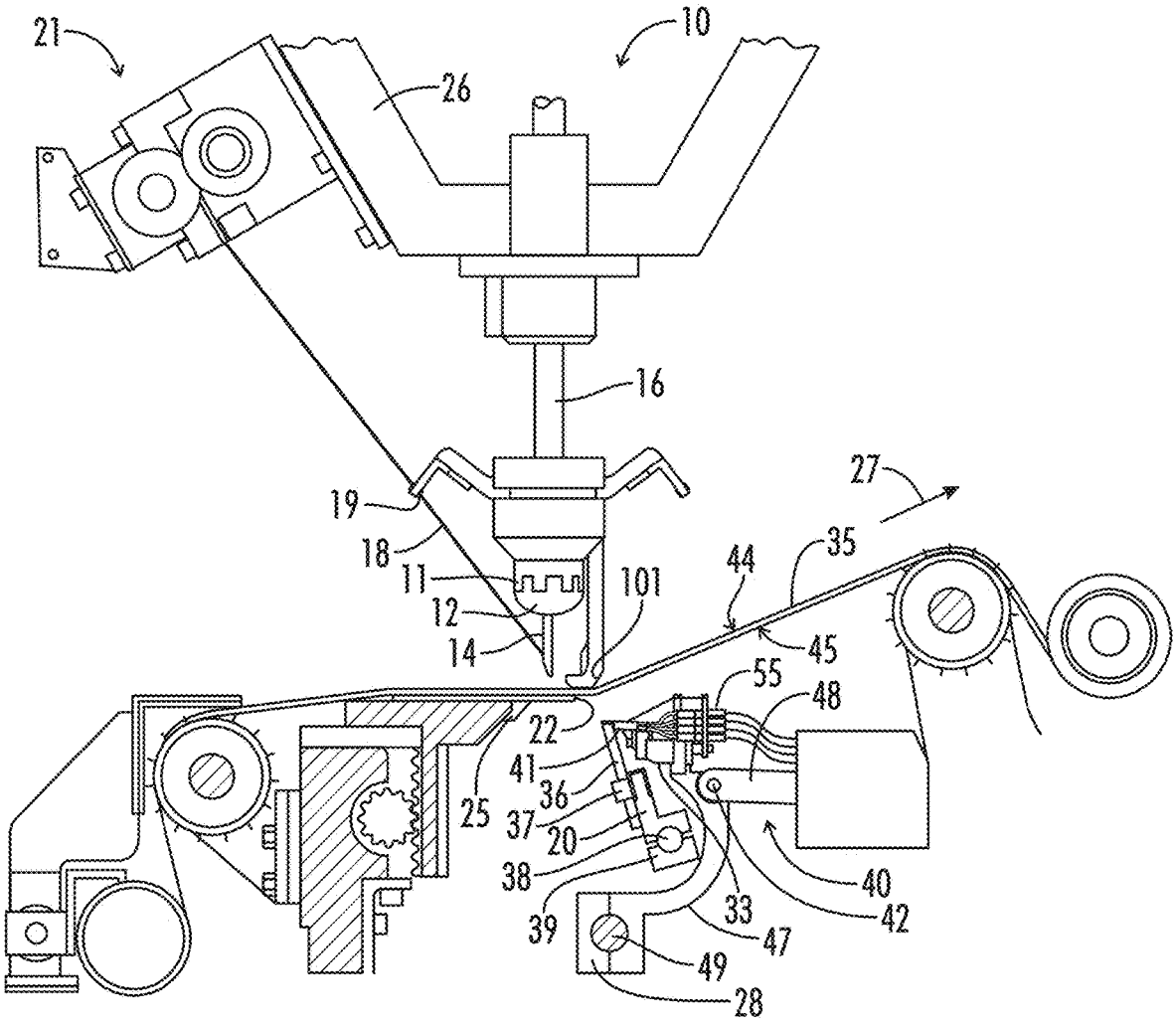
FIG. 1 (PRIOR ART)
FIG. 1 is a partial sectional end view of a prior art tufting machine with a single row of needles that can be operated to place yarns in the manufacture of fabrics with cut and loop face yarns.

Referring now to the drawings in more detail, FIG. 1 discloses a multiple needle tufting machine 10 including an elongated transverse needle bar carrier 11 supporting a needle bar 12. The needle bar 12 supports a row of transversely spaced needles 14. The needle bar carrier 11 is connected to a plurality of push rods 16 adapted to be vertically reciprocated by conventional needle drive mechanism, not shown, within the upper housing 26.

Yarns 18 are supplied to the corresponding needles 14 through corresponding apertures in the yarn guide plate 19 from a yarn supply, not shown, such as yarn feed rolls, beams, creels, or other known yarn supply means, preferably passing through pattern yarn feed control 21 though simpler yarn feed arrangements such as roll feeds may be employed. The yarn feed control 21 interfaces with a controller to feed yarns in accordance with pattern information and in synchronization with the needle drive, shifters, yarn seizing/cutting mechanisms and backing fabric feed.

The needle bar 12 may be fixedly mounted to the needle bar carrier 11 or may slide within the needle bar carrier 11 for transverse or lateral shifting movement by appropriate pattern control needle shifter mechanisms, in well-known manners. The backing fabric 35 is supported upon the needle plate 25 having rearward projecting transversely spaced front needle plate fingers 22, the fabric 35 being adopted for longitudinal movement from front-to-rear in a feeding direction, indicated by the arrow 27, through the tufting machine 10. The needle bar may have a single row of gauge spaced needles as shown, or may be a staggered needle bar with front and rear rows of needles, or may even be two separate needle bars, each with a row of needles.

The needle drive mechanism, not shown, is designed to actuate the push rods 16 to vertically reciprocate the needle bar 12 to cause the needles 14 to simultaneously penetrate the backing fabric 35 far enough to carry the respective yarns 18 through the back-stitch side 44 of backing fabric 35 to form loops on the face 45 thereof. After the loops are formed in this tufting zone, the needles 14 are vertically withdrawn to their elevated, retracted positions. A yarn seizing apparatus 40 in accordance with this illustration includes a plurality of gated hooks 41, there preferably being at least one gated hook 41 for each needle 14.

Each gated hook 41 is provided with a shank received in a corresponding slot in a hook bar 33 in a conventional manner. The gated hooks 41 may have the same transverse spacing or gauge as the needles 14 and are arranged so that the bill of a hook 41 is adapted to cross and engage with each corresponding needle 14 when the needle 14 is in its lower most position. Gated hooks 41 operate to seize the yarn 18 and form a loop therein when the sliding gate is closed by an associated pneumatic cylinder 55, and to shed the loop as the gated hooks 41 are rocked.

The elongated, transverse hook bar 33 and associated pneumatic assembly are mounted on the upper end portion of a C-shaped rocker arm 47. The lower end of the rocker arm 47 is fixed by a clamp bracket 28 to a transverse shaft 49. The upper portion of the rocker arm 47 is connected by a pivot pin 42 to a link bar 48, the opposite end of which is connected to be driven or reciprocally rotated by conventional looper drive. Adapted to cooperate with each hook 41 is a knife 36 supported in a knife holder 37 fixed to knife block 20. The knife blocks 20 are fixed by brackets 39 to the knife shaft 38 adapted to be reciprocally rotated in timed relationship with the driven rocker arm 47 in a conventional manner. Each knife 36 is adapted to cut loops formed by each needle 14 upon the bill of the hook 41 from the yarn 18 when gates are retracted and yarn loops are received on the hooks 41. A preferred gated hook assembly is disclosed in U.S. Pat. No. 7,222,576 which is incorporated herein by reference.

It can be seen in FIG. 1 that the tufted greige 35 with backstitch side 44 and face side 45 is lifted away from the tufting zone after passing presser foot 101. When employing a backing shifter, it is necessary to move the face side 45 away from the hook apparatus of a cut pile or cut loop configuration as the lateral shifting of the backing could cause interference between the tufted yarns on the face 45 and the hooks 41. For the purposes of using the backing shifting apparatus of the present invention, it is preferable that the yarn seizing gauge parts be loopers that are disengaged from the loops of yarn after each stitch rather than hooks that often need to carry a yarn for one or more additional stitches to effect a cut pile.

Figure 2A:
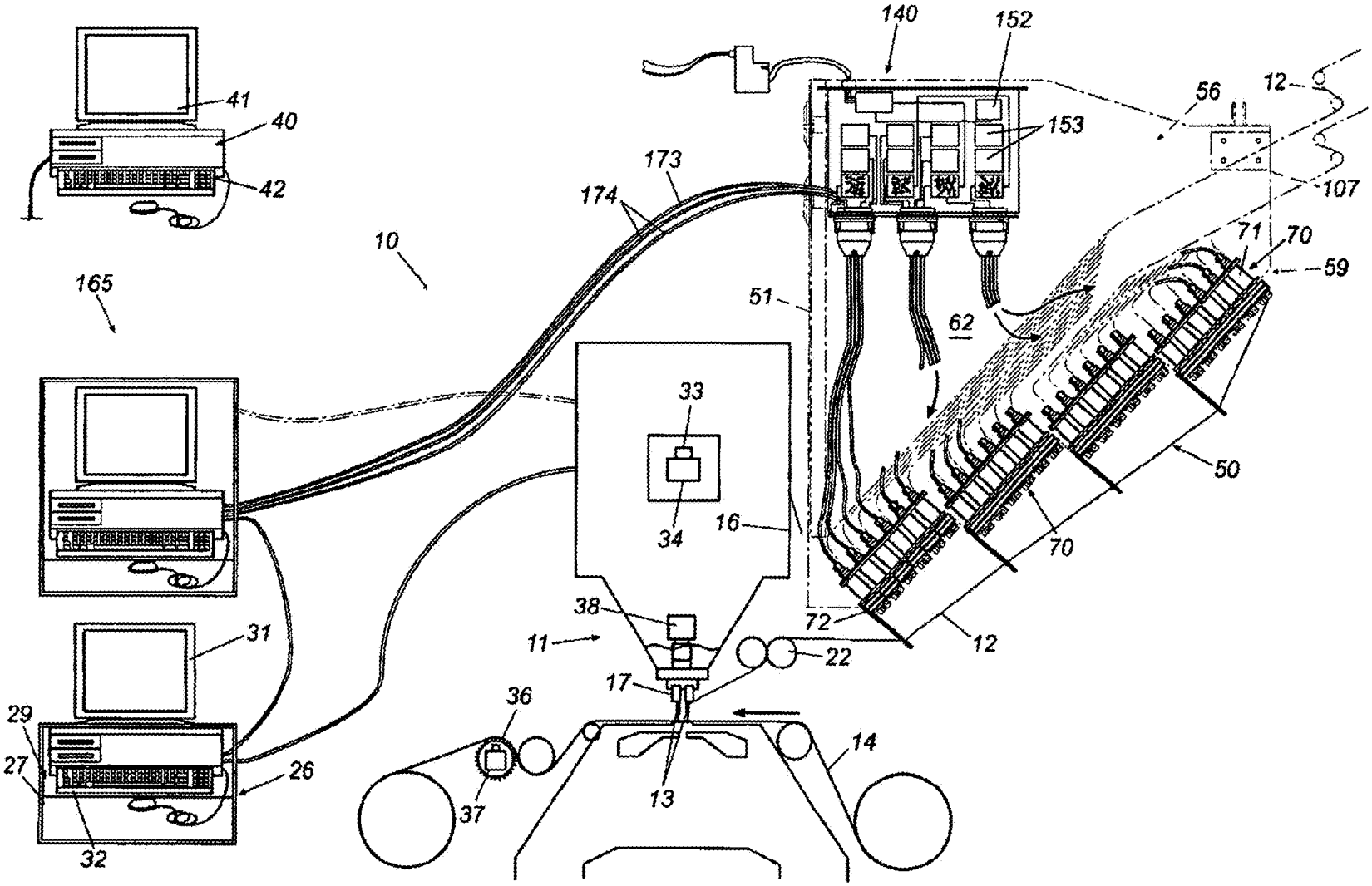
FIG. 2A (PRIOR ART)
FIG. 2A is a prior art schematic illustration of the operative components of a tufting machine equipped with a pattern control yarn feed.
Figure 2B:
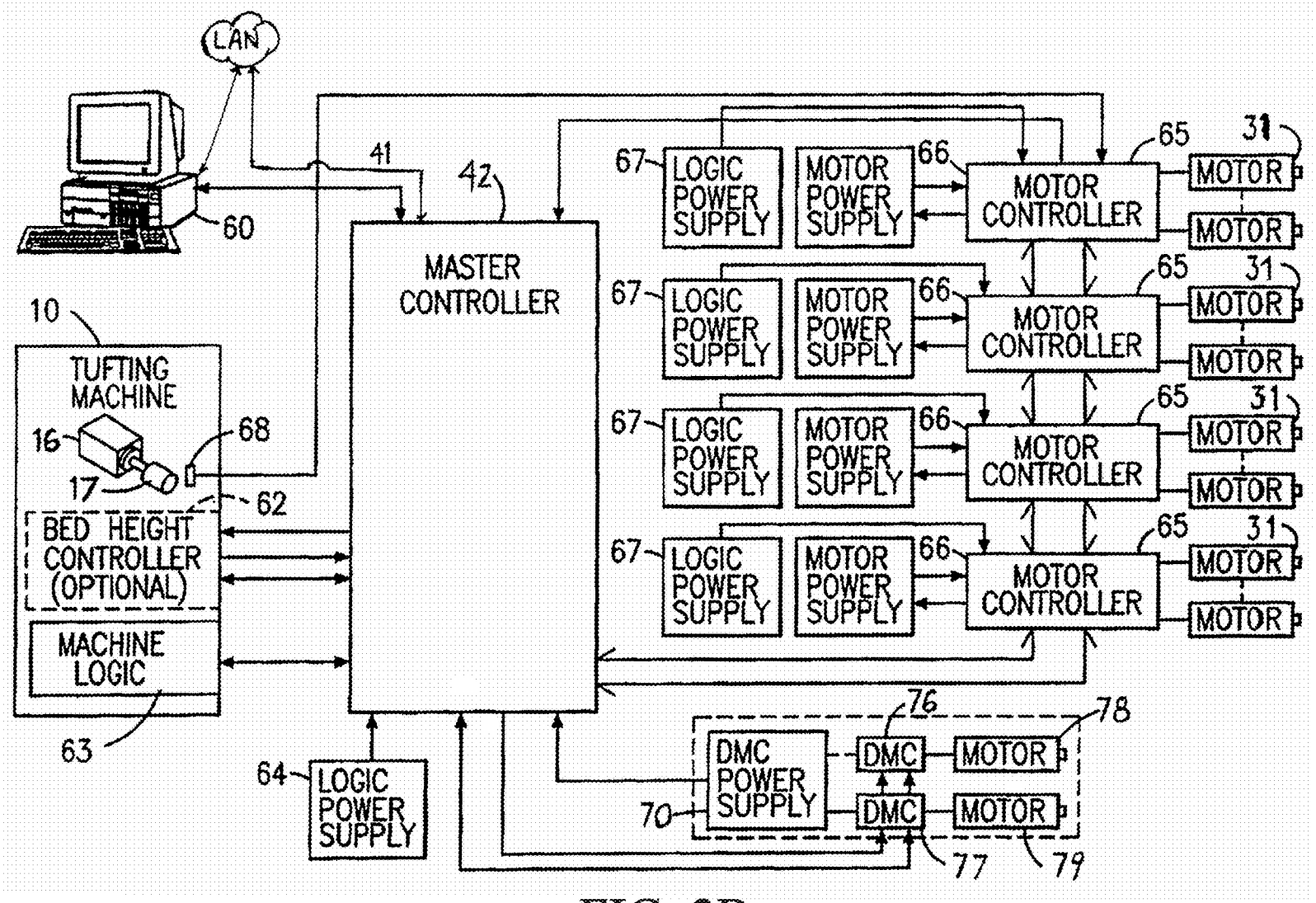
FIG. 2B (PRIOR ART)
FIG. 2B is a prior art schematic illustration of the operative components of an alternative tufting machine embodiment equipped with a pattern control yarn feed.
Figure 4A:
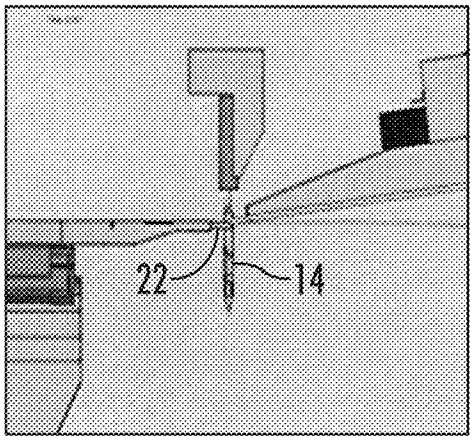
FIGS. 4A-4F are sequential side plan views of a tufting cycle corresponding to FIGS. 3A-3F.
Figure 3A:
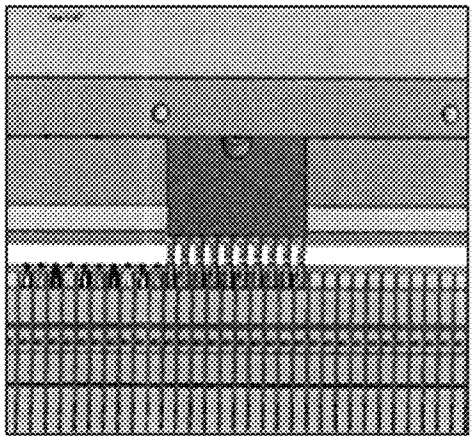
FIGS. 3A-3F are sequential front plan view of a tufting cycle of shifting backing feed and reciprocating needle plate through a tufting cycle.

FIGS. 2A and 2B illustrate the control systems for tufting machines capable of single or double end yarn control on a stitch by stitch basis, and capable of selective yarn placement. As indicated in FIG. 2A, the tufting machine 11 includes a tufting machine controller or control unit 26, such as disclosed in U.S. Pat. No. 5,979,344 in the case of machines manufactured by Card Monroe Corp., that monitors and controls the various operative elements of the tufting machine, such as the reciprocation of the needle bars, backing feed, shifting of the needle bars, bedplate position, etc. Such a machine controller 26 typically includes a cabinet or work station 27 housing a control computer or processor 28, and a user interface 29 that can include a monitor 31 and an input device 32, such as a keyboard, mouse, keypad, drawing tablet, or similar input device or system. The tufting machine controller 26 controls and monitors feedback from various operative or drive elements of the tufting machine such as receiving feedback from a main shaft encoder 33 for controlling a main shaft drive motor 34 so as to control the reciprocation of the needles, and monitoring feedback from a backing feed encoder 36 for use in controlling the drive motor 37 for the backing feed rolls to control the stitch rate or feed rate for the backing material. A needle sensor or proximity switch (not shown) also can be mounted to the frame in a position to provide further position feedback regarding the needles. In addition, for shiftable needle bar tufting machines, the controller 26 further will monitor and control the operation of needle bar shifter mechanism(s) 38 for shifting the needle bars 17 according to programmed pattern instructions.

The tufting machine controller 26 receives and stores such programmed pattern instructions or information for a series of different carpet patterns. These pattern instructions can be stored as a data file in memory at the tufting machine controller itself for recall by an operator, or can be downloaded or otherwise input into the tufting machine controller by the means of a digital recording medium such as a USB flash drive, direct input by an operator at the tufting machine controller, or from a network server via network connection. In addition, the tufting machine controller can receive inputs directly from or through a network connection from a design center 40. The design center 40 can include a separate or stand-alone design center or work station computer 41 with monitor 42 and user input 43, such as a keyboard, drawing tablet, mouse, etc., through which an operator can design and create various tufted carpet patterns. This design center also can be located with or at the tufting machine or can be much more remote from the tufting machine.

An operator can create a pattern data file or graphic representations of the desired carpet pattern at the design center computer 41, which will calculate the various parameters required for tufting such a carpet pattern at the tufting machine, including calculating yarn feed rates, pile heights, backing feed or stitch rate, and other required parameters for tufting the pattern. These pattern data files typically then will be downloaded or transferred to the machine controller, to a thumb drive or similar recording medium, or can be stored in memory either at the design center or on a network server for later transfer and/or downloading to the tufting machine controller. Further, for design center located work stations and/or where the machine controller has design center functionality or components programmed therein, it is preferable, although not necessarily required, that the design center 40 and/or machine controller 26 be programmed with and use common Internet protocols (i.e., web browser, FTP, etc.) and have a modem, Internet, or network connection to enable remote access and trouble shooting.

The yarn feed system 10 comprises a yarn feed unit or attachment 50 that can be constructed as a substantially standardized, self-contained unit or attachment capable of being releasably mounted to and removable from the tufting machine frame 16 as a one-piece unit or attachment. This enables the manufacture of substantially standardized yarn-feed units capable of controlling the feeding of individual yarns to a predetermined number or set of needles of the tufting machine.

The yarn feed unit 50 further includes a series of yarn feed devices 70 that are received and removably mounted within the housing 56 of the yarn feed unit. The yarn feed devices engage and feed individual yarns to associated needles of the tufting machine for individual or single end yarn feed control, although in some configurations, the yarn feed devices also can be used to feed multiple yarns to selected sets or groups of needles. For example, in a machine with 2,000 needles, each yarn feed unit could control two or more yarns such that 1,000 or fewer yarn feed units can be used to feed the yarns to the needles. Each of the yarn feed devices 70 includes a drive motor 71 that is received or releasably mounted within a motor mounting plate 72, mounted to the frame 51 of the yarn feed unit 50 along the front face or side 59 of the housing 56. The motor mounting plates 72 include a series of openings or apertures 73 in which a drive motor 71 is received for mounting.

In some cases yarns may be directed from the yarn feed device 70 to needles 14 in a direct fashion. In other cases, a series of yarn feed tubes are extended along the open interior area 62 of the yarn feed unit housing 56. Each of the yarn feed tubes 105 is formed from a metal such as aluminum or can be formed from various other types of metals or synthetic materials having reduced frictional coefficients so as to reduce the drag exerted on the yarns. The yarn feed tubes 105 extend from an upper or first end 106 adjacent a yarn guide plate 107 mounted to the front face or surface of the housing 56, and extend at varying lengths, each terminating at a lower or terminal end 108 adjacent a drive motor 71.

The system controller communicates with each of the yarn feed controllers via the network cables 173,174 and 176,177, with feedback reports being provided from the yarn feed controllers to the system controller over the first, feedback or real-time network (via network cable 173) so as to provide a substantially constant stream of information/feedback regarding the drive motors 71. Pattern control instructions or motor gearing/ratio change information for causing the motor controllers 152 to increase or decrease the speed of the drive motors 71 and thus change the rate of feed of the yarns as needed to produce the desired pattern step(s), are sent to the control processors 152 of the yarn feed controllers 140 over the pattern control information network cables 174.

The system controller further can be accessed or connected to the design center computer 40 through such communications package or system, either remotely or through a LAN/WAN connection to enable patterns or designs saved at the design center itself to be downloaded or transferred to the system controller for operation of the yarn feed unit. The system design center computer further has, in addition to drawing or pattern design functions or capabilities, operational controls that allow it to enable or disable the yarn feed motors, change yarn feed parameters, check and clear error conditions, and guide the yarn feed motors. As discussed above, such a design center component, including the ability to draw or program/create patterns also can be provided at the tufting machine controller 26, which can then communicate the programmed pattern instructions to the system controller, or further can be programmed or installed on the system controller itself. Thus, the system controller can be provided with design center capability so as to enable an operator to draw and create desired carpet patterns directly at the system controller.

In operation of the yarn feed control system 10, in an initial step, the system controller 165 of the yarn feed controller system 10, and the tufting machine controller 26 are powered on, after which the tufting machine controller proceeds to establish existing machine parameters such as reciprocation of the needles, backing feed, bed rail height, etc. The operator then selects a carpet pattern to be run on the tufting machine. This carpet pattern can be selected from memory, stored at a network server from which a carpet pattern data file will be downloaded to internal memory of the tufting machine or system controller, or stored directly in memory at the tufting machine controller or system controller.

Alternatively, the pattern or pattern data file can be created at a design center. The design center calculates yarn feed rates and/or ratios, and pile heights for each pattern step, and will create a pattern data file, which is then saved to memory. After the desired carpet pattern has been selected, the pattern information typically is then loaded into the system controller 165 of the yarn feed control system 10. Alternatively, as explained below in connection with the rescaling methods the operator can scale the desired carpet pattern. The operator then starts the operation of the yarn feed control system, whereupon the yarn feed devices 70 pull and feed yarns from a creel (not shown) at varying rates according to the programmed pattern information, which yarns are fed to puller rolls 22, which in tum, feed the yarns directly to the individual needles 13 of the tufting machine 11. The system controller sends pattern control instructions or signals regarding yarn feed rates or motor gearing/feed that are rationed to the rotation of the main drive shaft of the tufting machine, individual yarns to the yarn feed controllers 140 via control information network cables 174. Such pattern control instructions or signals/information are received by the control processors 152, which route specific pattern control instructions to the motor controllers or drives 153, which accordingly cause their drive motors 71 to increase or decrease the feeding of the yarns 12, as indicated at 221, as required for pattern step.

As further indicated at 223, the motor controllers monitor each of the drive motors under their control and provide substantially real-time feedback information 224 to the system controller, which is further receiving control and/or position information regarding the operation of the main shaft and the backing feed from the tufting machine controller that is monitoring the main shaft and backing feed encoders, needle bar shift mechanism(s) and other operative elements of the tufting machine. This feedback information is used by the system controller to increase or decrease the feed rates for individual yarns, as needed for each upcoming pattern step for the formation of the desired or programmed carpet pattern. After the pattern has been completed, the operation of the yarn feed control system will be halted or powered off, as indicated in 225.

Turning now to FIG. 2B, a general electrical diagram is shown of a computerized tufting machine with main drive motor 19 and drive shaft 17. A personal computer 60 is provided as a user interface, and this computer 60 may also be used to create, modify, display and install patterns in the tufting machine 10 by communication with the tufting machine master controller 42.

Due to the very complex patterns that can be tufted when individually controlling each end of yarn, many patterns will comprise large data files that are advantageously loaded to the master controller by a network connection 61; and preferably a high bandwidth network connection.

Master controller 42 preferably interfaces with machine logic 63, so that various operational interlocks will be activated if, for instance, the controller 42 is signaled that the tufting machine 10 is turned off, or if the "jog" button is depressed to incrementally move the needle bar, or a housing panel is open, or the like. Master controller 42 may also interface with a bed height controller 62 on the tufting machine to automatically effect changes in the bed height when patterns are changed. Master controller 42 also receives information from encoder 68 relative to the position of the main drive shaft 17 and preferably sends pattern commands to and receives status information from controllers 76, 77 for backing tension motor 78 and backing feed motor 79 respectively. Said motors 78, 79 are powered by power supply 70. Finally, master controller 42, for the purposes, sends ratiometric pattern information to the servo motor controller boards 65. The master controller 42 will signal particular servo motor controller board 65 that it needs to spin its particular servo motors 31 at given revolutions for the next revolution of the main drive shaft 17 in order to control the pattern design. The servo motors 31 in turn provide positional control information to their servo motor controller board 65 thus allowing two-way processing of positional information. Power supplies 67, 66 are associated with each servo motor controller board 65 and motor 31.

Master controller 42 also receives information relative to the position of the main drive shaft 17. Servo motor controller boards 65 process the ratiometric information and main drive shaft positional information from master controller 42 to direct servo motors 31 to rotate yarn feed rolls 28 the distance required to feed the appropriate yarn amount for each stitch.

When adapted for use with a reciprocating needleplate, the master controller also has to provide signals to control the additional axis for the rotation of the cam in a fashion that is essentially rotating a cam profile through a single revolution for each tufting cycle. The cam profile and speed of rotation determines the longitudinal movement imparted to the needleplate and the speed of movement.

Figure 5A:
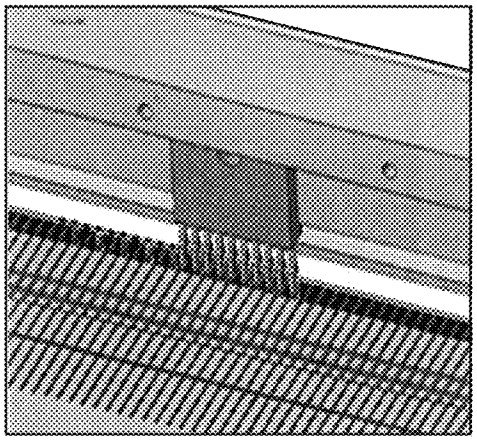
FIGS. 5A-5F are sequential front perspective views of a tufting cycle corresponding to FIGS. 3A-3F.
Figure 5B:
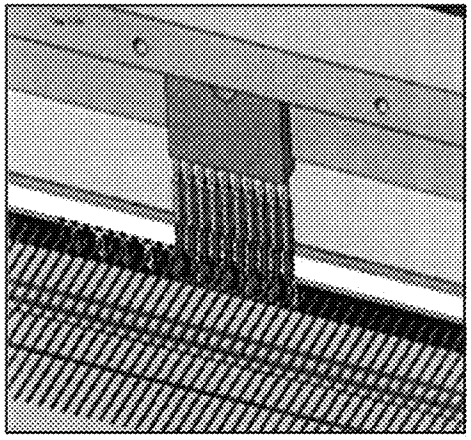
Figure 4B:
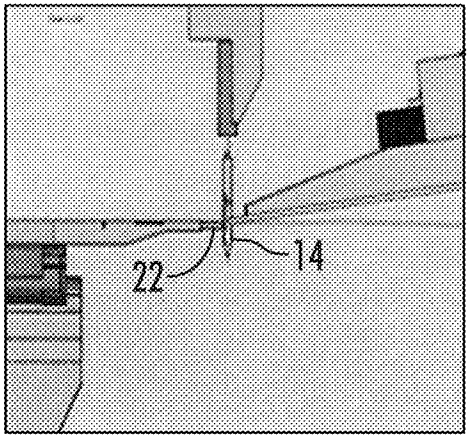
Figure 3B:
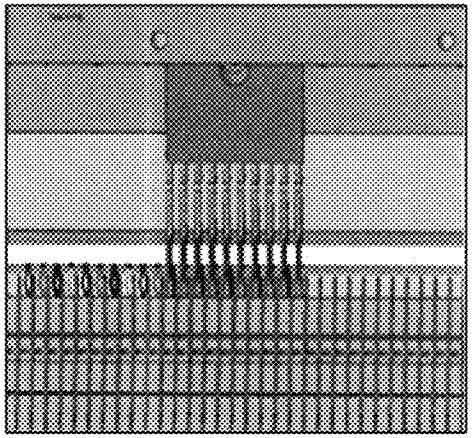
Figure 5C:
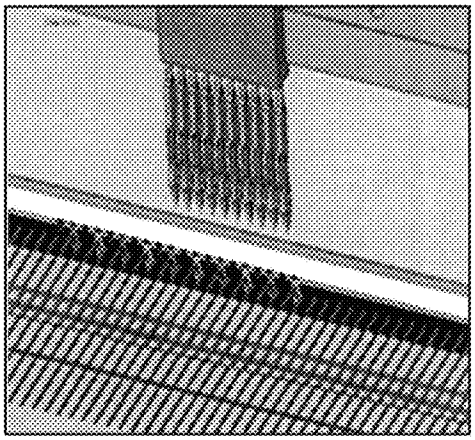
Figure 4C:
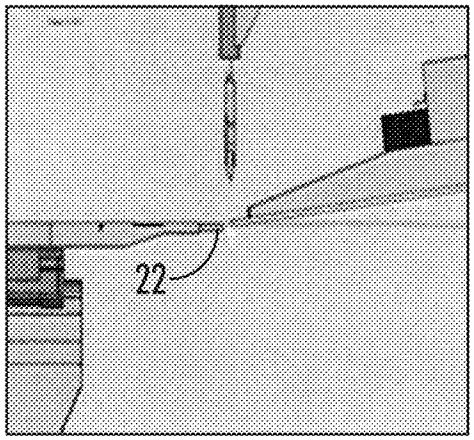
Figure 3C:
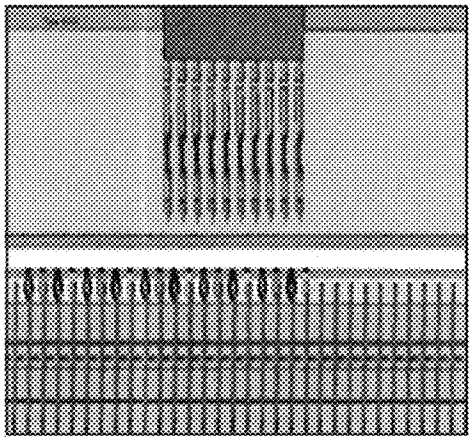
Figure 5D:
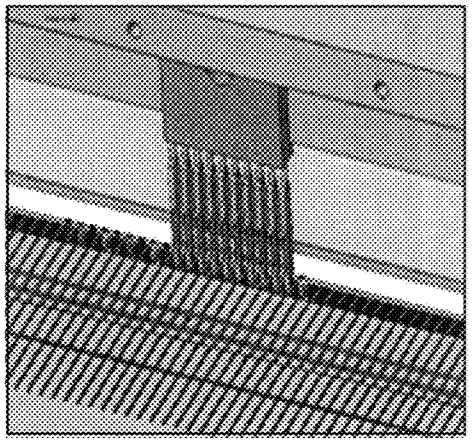
Figure 4D:
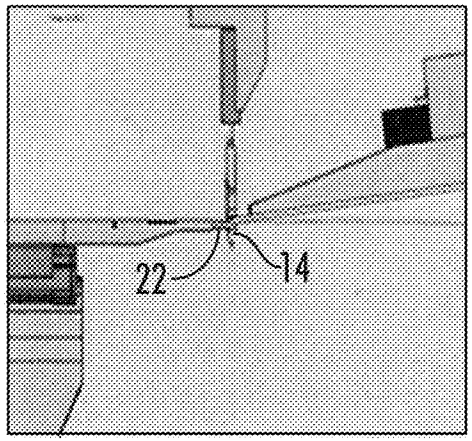
Figure 3D:
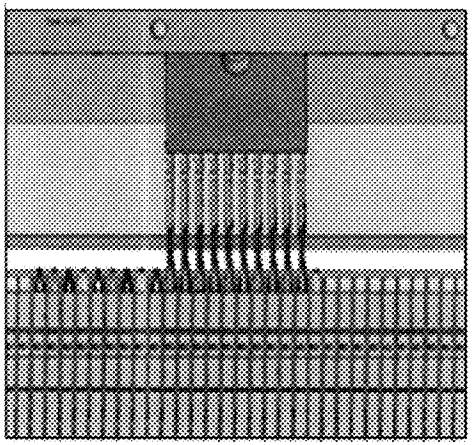
Figure 5E:
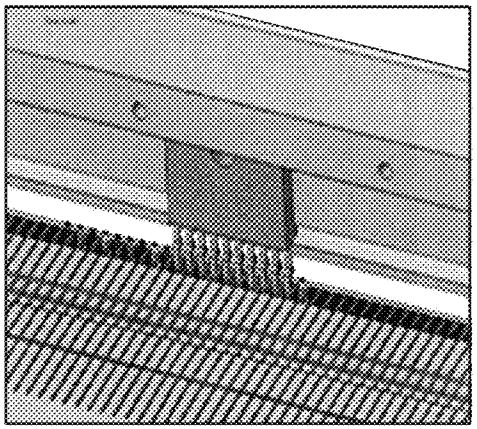
Figure 4E:
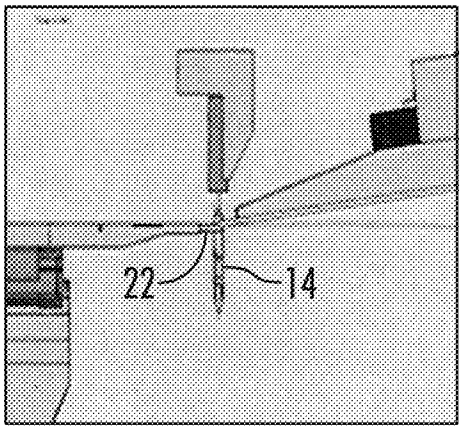
Figure 3E:
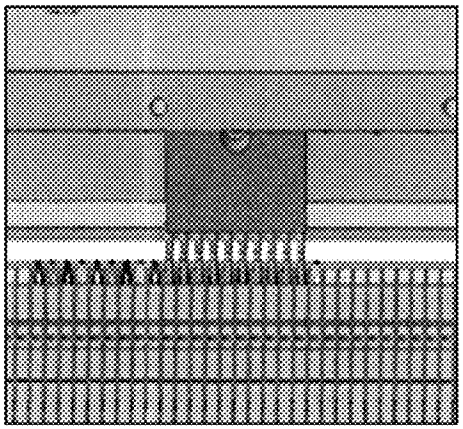
Figure 5F:
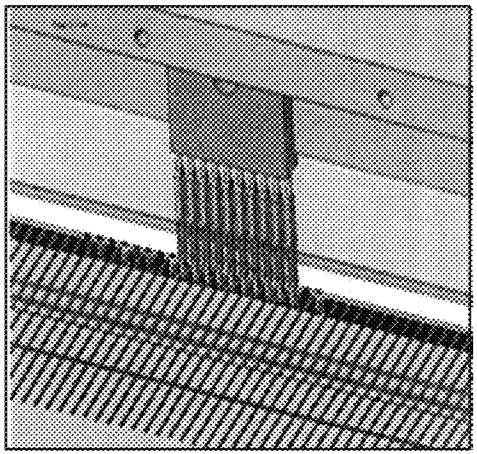
Figure 4F:
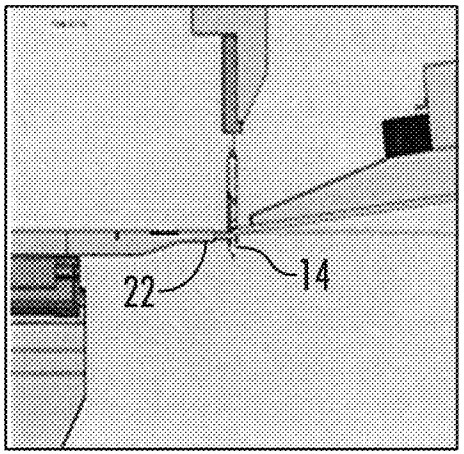
Figure 3F:
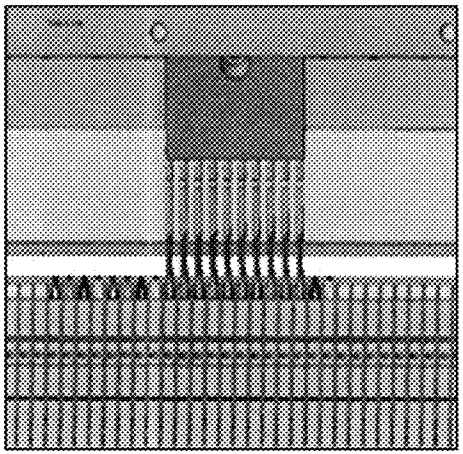

FIGS. 3A-F and corresponding views in FIGS. 4A-F and 5A-F illustrate the tufting zone movement of the needle plate fingers 22 in the new shiftable backing fabric design. It can be observed in FIGS. 3A, 4A, 5A that the needle plate finger 22 extends essentially to the presser foot and through much of the diameter of the needle 14 passing behind the needle plate finger. As the needle 14 moves upward retracting from the backing fabric, the needle plate finger is similarly retracted toward the front of the tufting machine as shown in FIGS. 3B, 4B, 5B. In FIGS. 3C, 4C, 5C, the needle is free of the backing fabric and space exists between the needle plate fingers 22 and presser foot. As the needles 14 again move downward in FIGS. 3D, 4D, 5D, the needle plate fingers 22 move forward to support the backing fabric and remain in that position through the downward stroke as shown in FIGS. 3E, 4E, 5E but again begin to retract as needles 14 are removed from the backing fabric in FIGS. 3F, 4F, 5F.

Figure 6A:
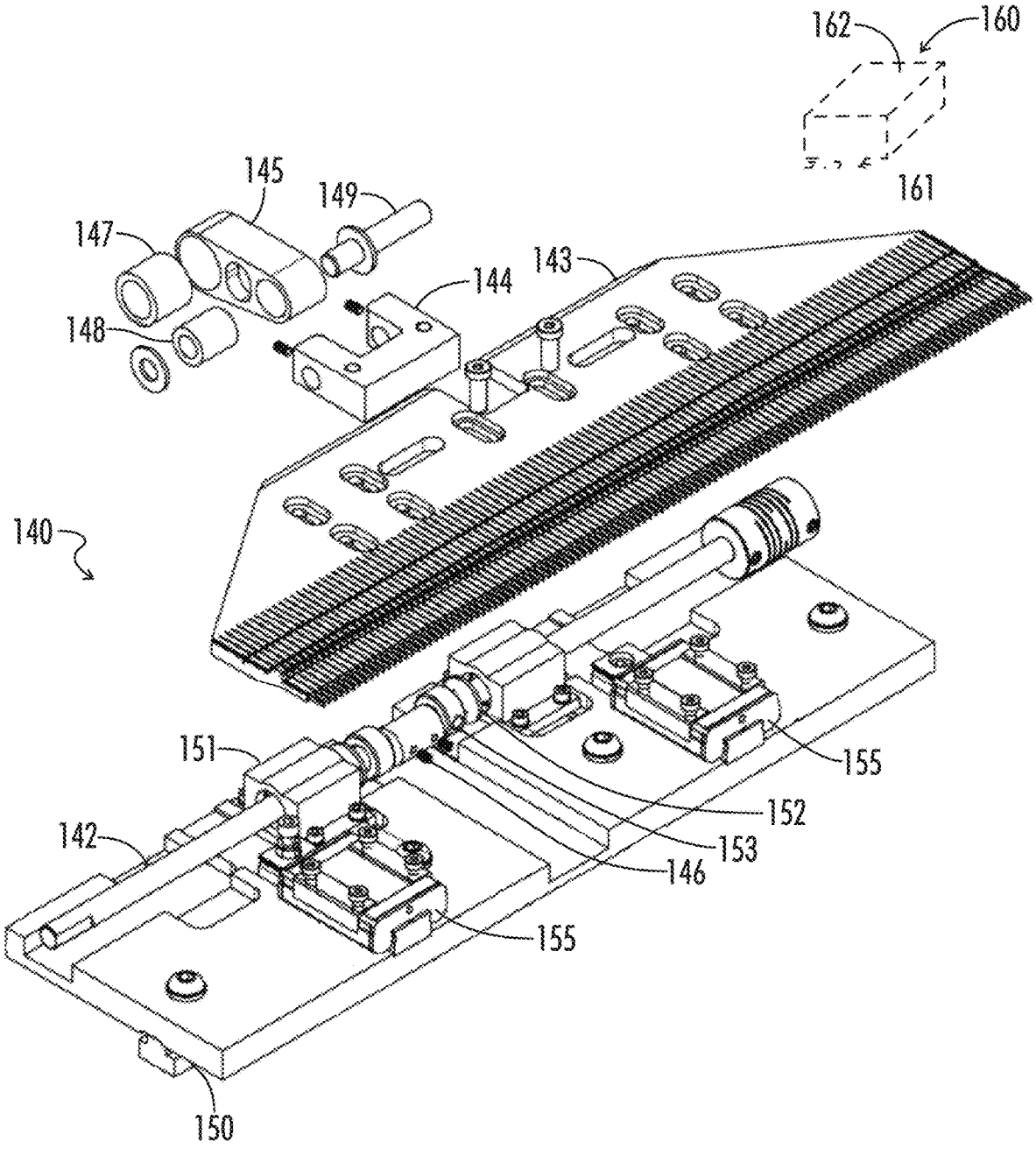
FIG. 6A is an exploded view of a section of an exemplary reciprocating needle plate assembly.

Turning then to FIG. 6A, an exploded view of a reciprocating needle plate assembly 140 is shown. A base plate 150 secured to the tufting machine carries pillow blocks 151 with bearings to permit the rotation of shaft 142. Also, linear rail ball guides 155 are mounted to the base and the reciprocating needle plate 143 is mounted on those guides to control the longitudinal movement of the plate. The shaft 142 carries a cam 146 between collars 153 and thrust bearings 152 and pillow blocks 151. The cam 146 is set in a sleeve bearing 147 in one end of a connecting rod 145. The other end of the connecting rod 145 has a sleeve bearing 148 and is joined by a dowel 149 to wrist block 144 that is in turn fastened to the needle plate 143.

One feature that has proved helpful in maintaining the backing fabric in an unwrinkled state as it enters the tufting zone is the addition of temple roller assemblies 160 near each edge of the backing fabric. These assemblies contain temple rolls 161 that either by angular orientation as at pivots 162, or backing fabric engaging spike configuration, tend to keep the backing fabric stretched to its full width. Other tentering apparatus may also be used to the same effect.

Figure 6B:
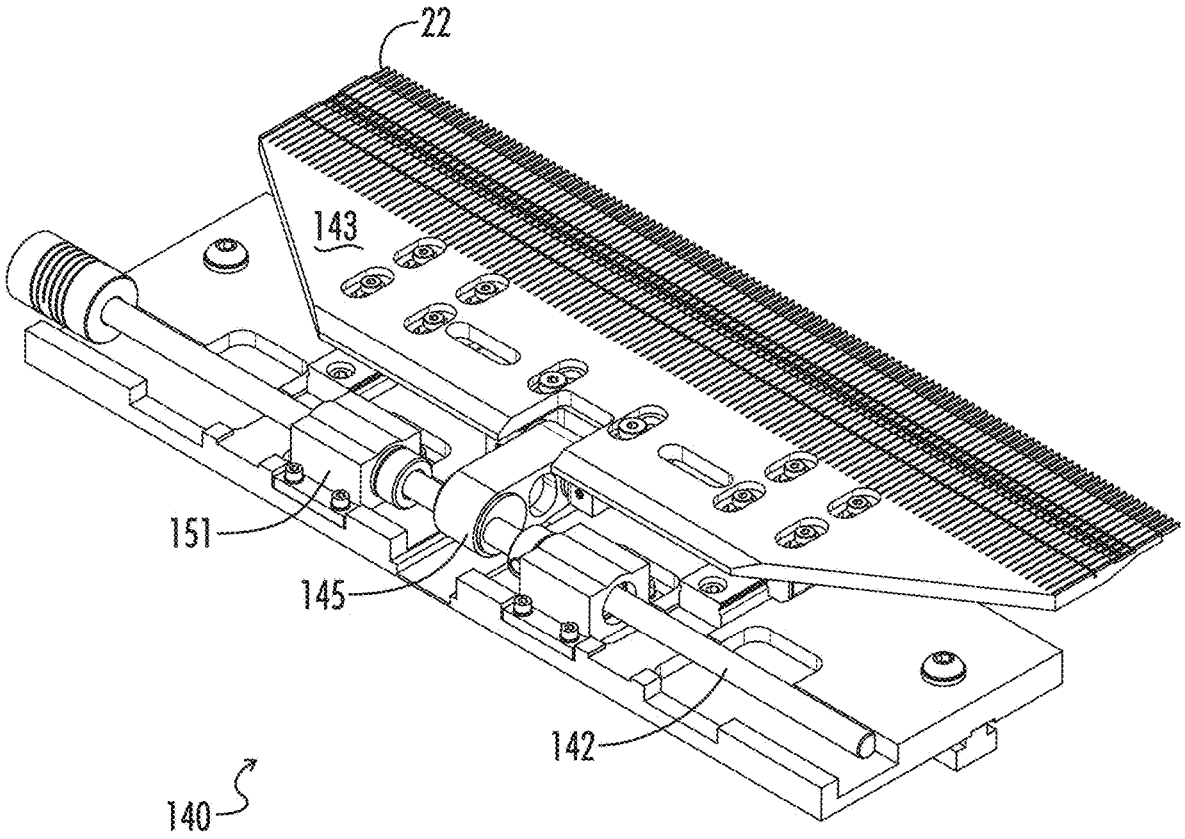
FIG. 6B is a perspective view of the reciprocating needle plate of FIG. 10A as put together for operation.

In FIG. 6B, it can be seen that the rotation of shaft 142 operated the cam to effect movement of the connecting rod 145 and the linear rail ball guides direct the needle plate 143 with rearwardly projecting needle plate fingers 22 to reciprocate in a forward and rearward direction. This movement corresponds to the movement shown in FIGS. 3-5. Shaft 142 is rotated by servo drive and this means of control allows for alterations to the timing, or reciprocation window, relative to the position of the needles in an independent and rapid fashion. Other techniques for driving reciprocating needle plates are possible such as by linkage with other driven systems such as the main drive motors or looper drive, the use of pneumatics, hydraulics, or linear drive motors.

Figure 7A:
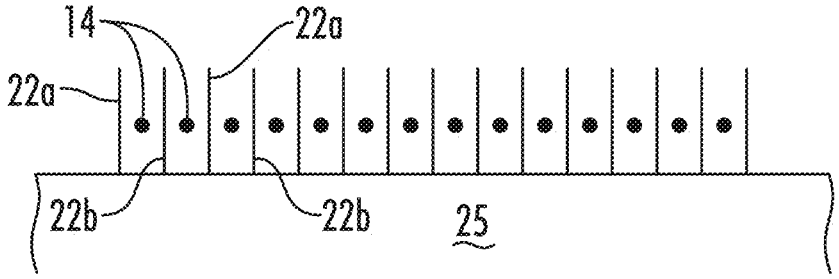
FIG. 7A is a top plan illustration of the needles and needle plate fingers of a reciprocating needle plate for a single row of needles.
Figure 7B:
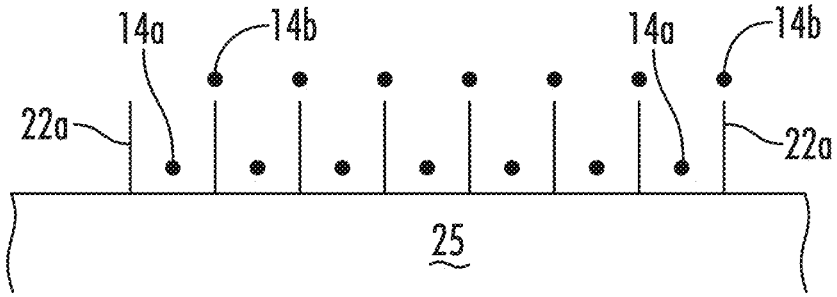
FIG. 7B is a top plan illustration of the location of the needles and needle plate fingers of a reciprocating needle plate for two rows of needles.

FIGS. 7A and 7B show the relative locations of needle plate fingers 22 and needles 14 in exemplary arrangements of one row of needles (FIG. 7A) and two rows of needles (FIG. 7B). When using a single row of needles 14 the needles are directly between needle plate fingers 22*a*, 22*b* at the time of penetrating the backing fabric. However, when two rows of needles are used, the front row of needles 14*a* are directly between needle plate fingers 22*a* at the time of penetrating the backing fabric. However the rear row of needles 14*b* are located just beyond the ends of needle plate fingers 22*a*. Thus, the backing fabric near front needles 14*a* is supported by needle plate fingers 22*a* on either side, but the fabric near rear needles 14*b* is supported only by the end of the adjacent needle plate finger 22*a*. To improve the fabric support, in either case, it is sometimes helpful to place a riser beneath the face of the tufted greige to lift the tufted fabric upward as soon after the presser bar as practicable.

Advantageously, and different from prior usage in broadloom tufting machines, the backing assembly can be precisely shifted for substantial distances, typically on the order of 1 to 2.5 inches in each direction from center. This provides tufting machine with great versatility and allows a quarter gauge tufting machine to simulate a $\frac{1}{8}^{th}$ gauge tufting machine and provides numerous patterning advantages. Furthermore, a $\frac{1}{8}^{th}$ gauge tufting machine can very nearly imitate a $\frac{1}{10}^{th}$ gauge tufting machine, although not all stitches will appear in perfectly aligned rows. By way of example, a $\frac{1}{8}^{th}$ gauge machine will most commonly tuft at a stitch rate of about 8 stitches per inch, thereby placing 64 stitches in a square inch of backing. A $\frac{1}{10}^{th}$ gauge machine will most commonly tuft at about 10 stitches per inch with a resulting 100 stitches being placed in a square inch of backing. However, by increasing the stitch rate of a $\frac{1}{8}^{th}$ gauge tufting machine equipped with backing shifter and reciprocating needle plate to 12.5 stitches per inch, a stitch density of 100 stitches per square inch. In cases where the stich rate is being increased by a multiple of the gauge of the backing shifter and reciprocating needle plate equipped machine, there may be a perfect pattern alignment. In other cases, the stitches may not align in exact longitudinal rows.

The failure to align in exact longitudinal rows may be perceived as an advantage in some tufting applications. For instance, solid color shifting is used when manufacturing solid color carpets to break up any streaks or irregularities in the yarns that might otherwise be noticeable. Residential solid color carpets are sometimes sewn on $\frac{5}{32}$nds or $\frac{3}{16}^{th}$ inch gauge staggered needle bars with two rows of needles. These needle bars require shifts of 0.375 or 0.3125 inches for the streak break-up shifting. With a backing shifter and reciprocating needle plate equipped tufting machine, shifts of as little as 0.10 inches, and perhaps 0.05 inches, could be employed. The smaller shifts permit greater machine speed and require less lateral yarn on the backstitch that is effectively lost to effective use.

Figure 8A:
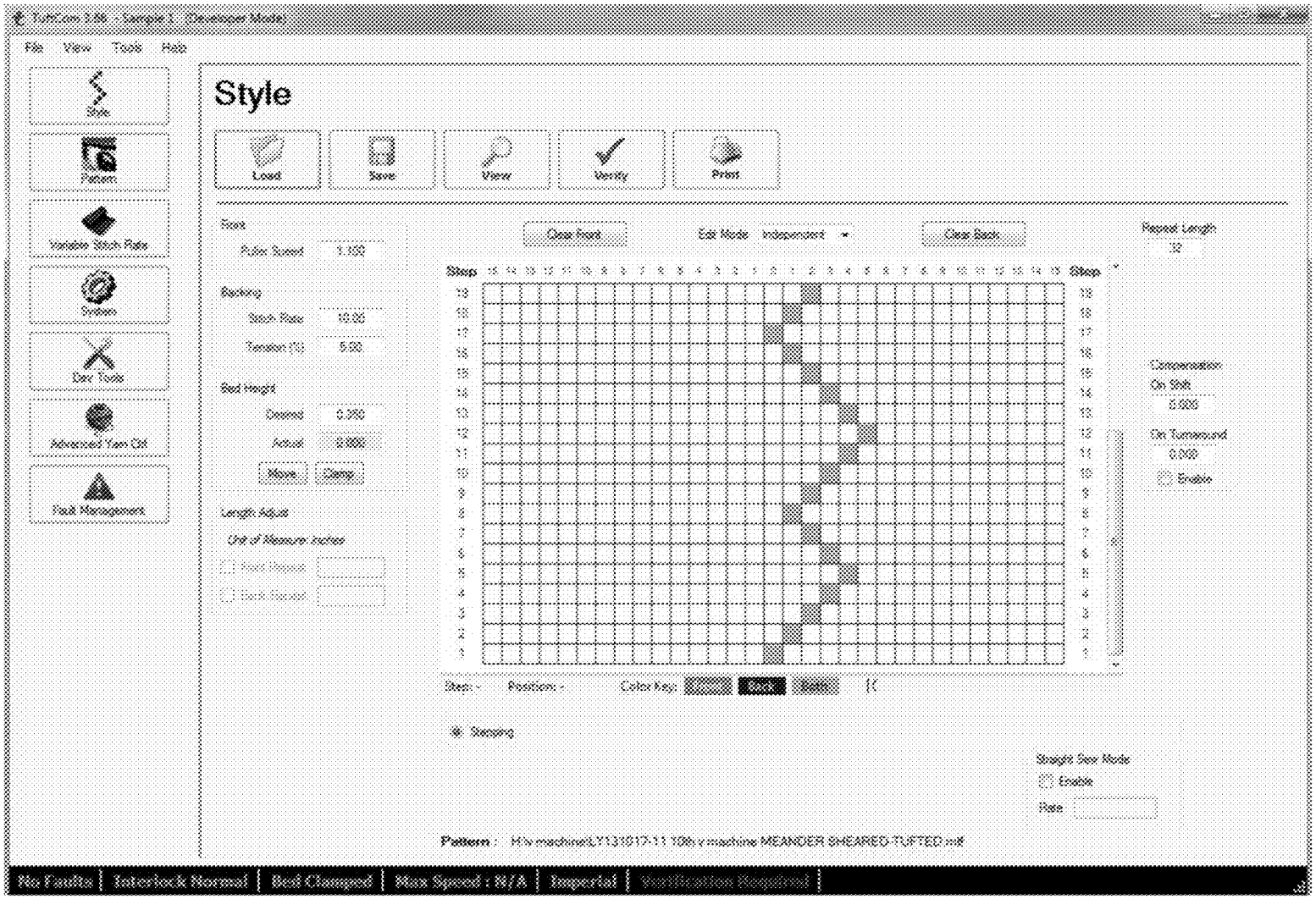
FIG. 8A is an operator interface screen from a tufting machine operable to produce variable gauge fabrics with yarn placement functionality, showing a shift pattern for two needle bars and basic tufting parameters.

FIG. 8A shows an operator interface screen for a tufting machine useful to create patterns involving yarn placement capabilities. Patterns can be created with one or two rows of needles. The operator can specify shift patterns for needle bars and for backing shifting, and the combination of back and forth shifting of the needlebar(s) by a single gauge unit with lateral shifting of the backing in repeated steps a total distance at least equal to the width of a repeat of the yarns threaded on the needle bar(s) can minimize the distance shifted in any single stitch cycle, allowing for faster machine operation. In FIG. 8A, the stitch rate is nominally set at 10 stitches per inch, however the actual number of stitches per inch will be 10 (spi) multiplied by the number of different yarns multiplied by the reciprocal of the gauge selected for the pattern.

Figure 8B:
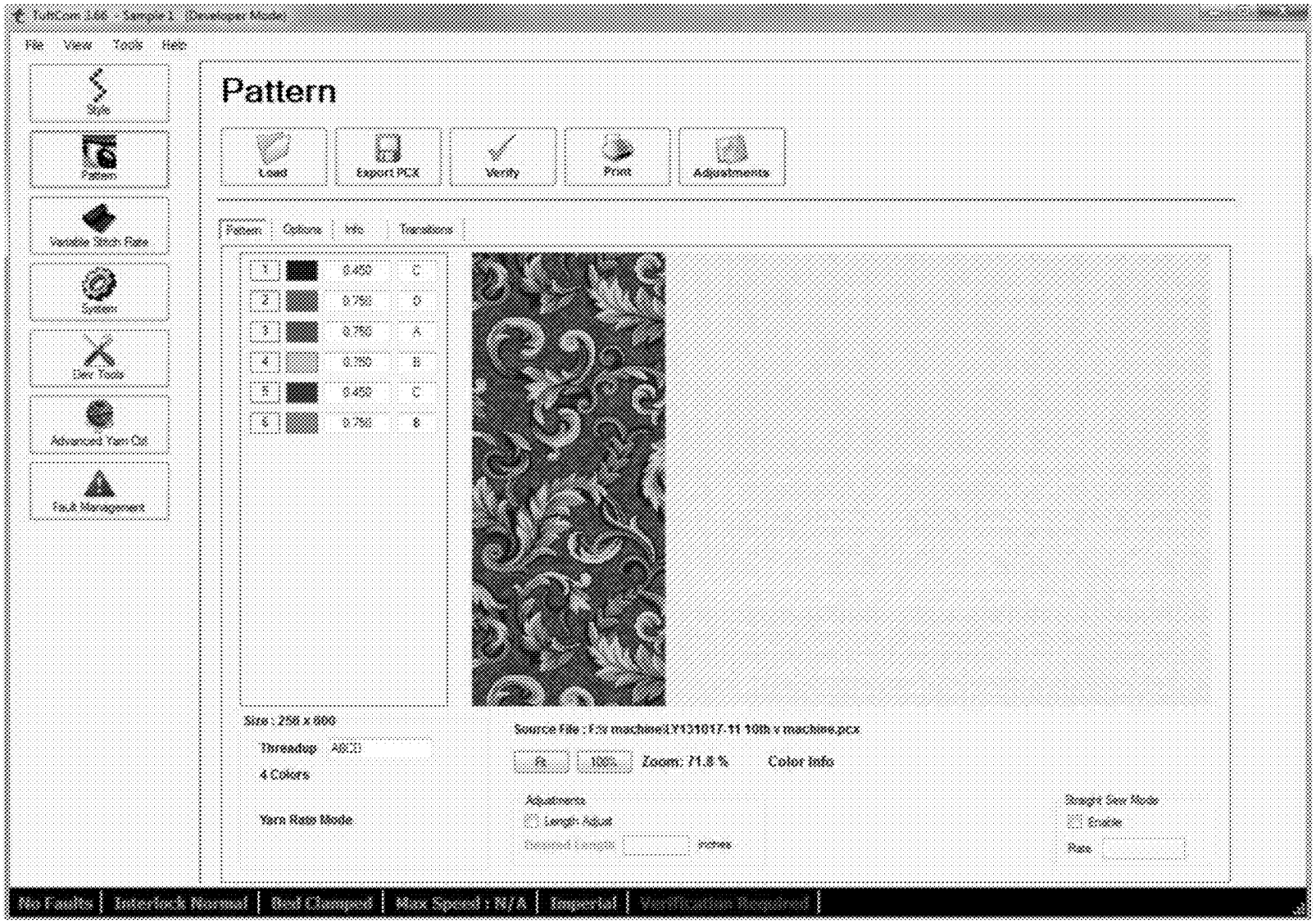
FIG. 8B is an operator interface screen from a tufting machine operable to produce variable gauge fabrics with yarn placement functionality, showing a four yarn threadup.
Figure 8C:
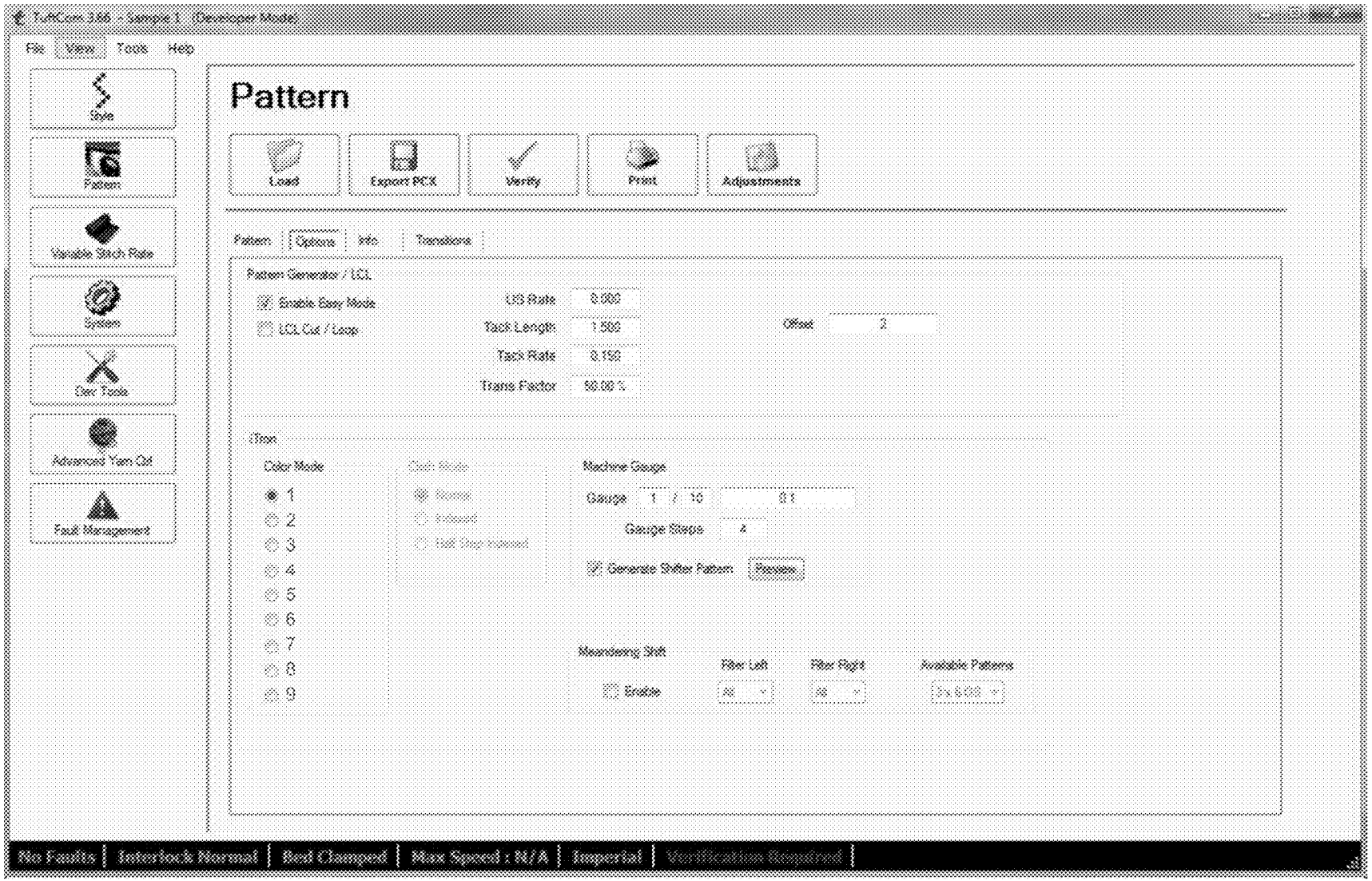
FIG. 8C is an operator interface screen from a tufting machine operable to produce variable gauge fabrics with yarn placement functionality, showing a yarn number and yarn feed parameters.

FIG. 8B shows the operator interface screen where the yarn thread up is assigned to the pattern and yarn pile heights assigned to different pile heights for each yarn. Illustrated is a four color threadup with high pile heights for each yarn and medium pile heights for two of the yarns. FIG. 8C shows another operator screen, with functionality combining that of hollow needle tufting machine and a yarn placement machine. Generally a two needle bar machine will have an even number color mode, and the machine gauge must be specified since the backing shifter allows for variable gauge. For yarn placement purposes, the yarn length for buried or pulled out stitches, as well as tacking stitches is specified.

Figure 9A:
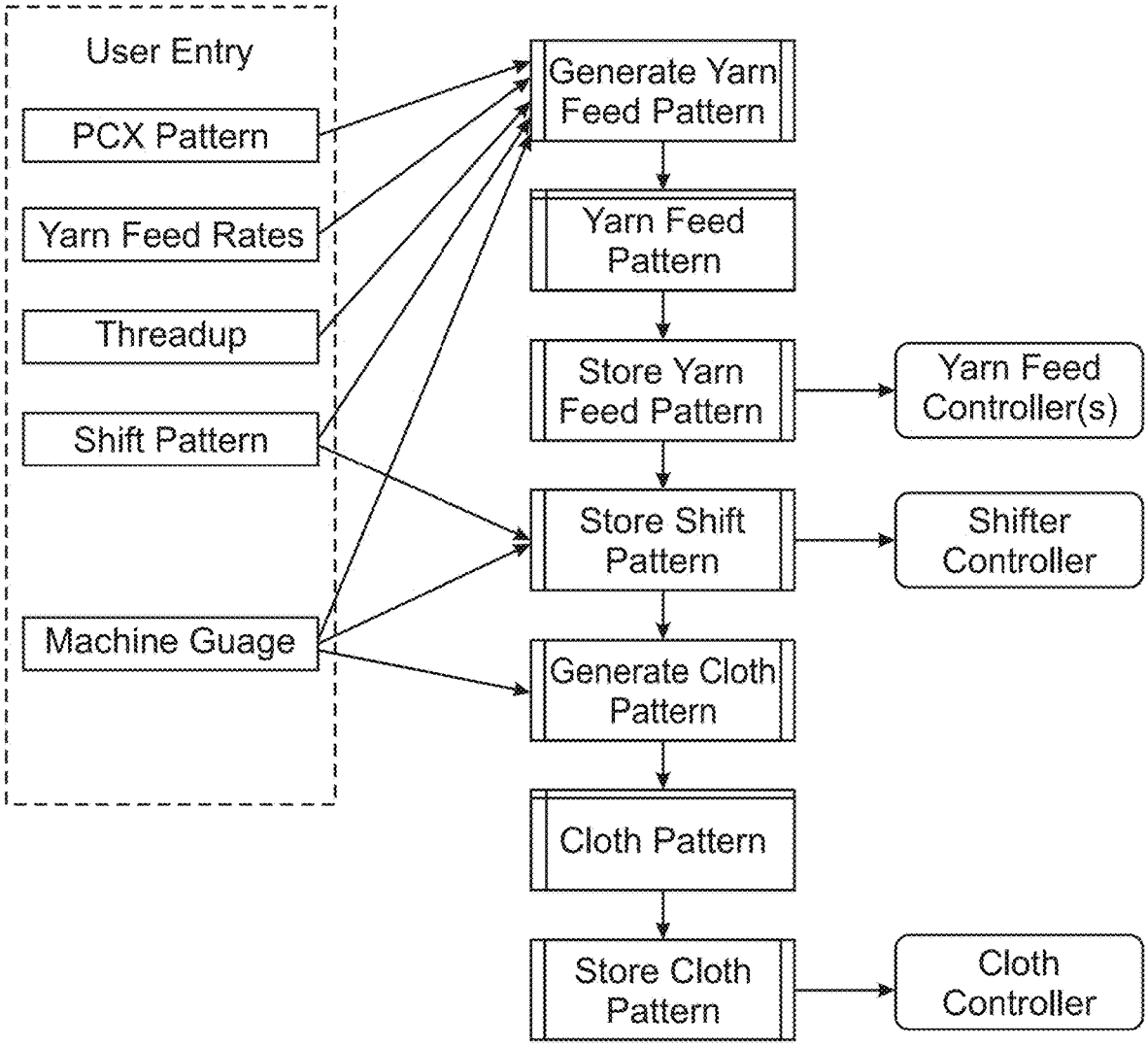
FIG. 9A is a schematic diagram illustrating the input of pattern data and processing to create pattern instructions for a tufting machine operable to produce fabrics with yarn placement functionality.

FIG. 9A provides an overview of how the data input from the pattern file is combined with the operator inputs to create pattern information files that are transmitted from the operator interface computer to the controllers for the appropriate axes of movement that cause the shifting, feeding, and reciprocation of parts that results in tufted fabrics.

Figure 9B:
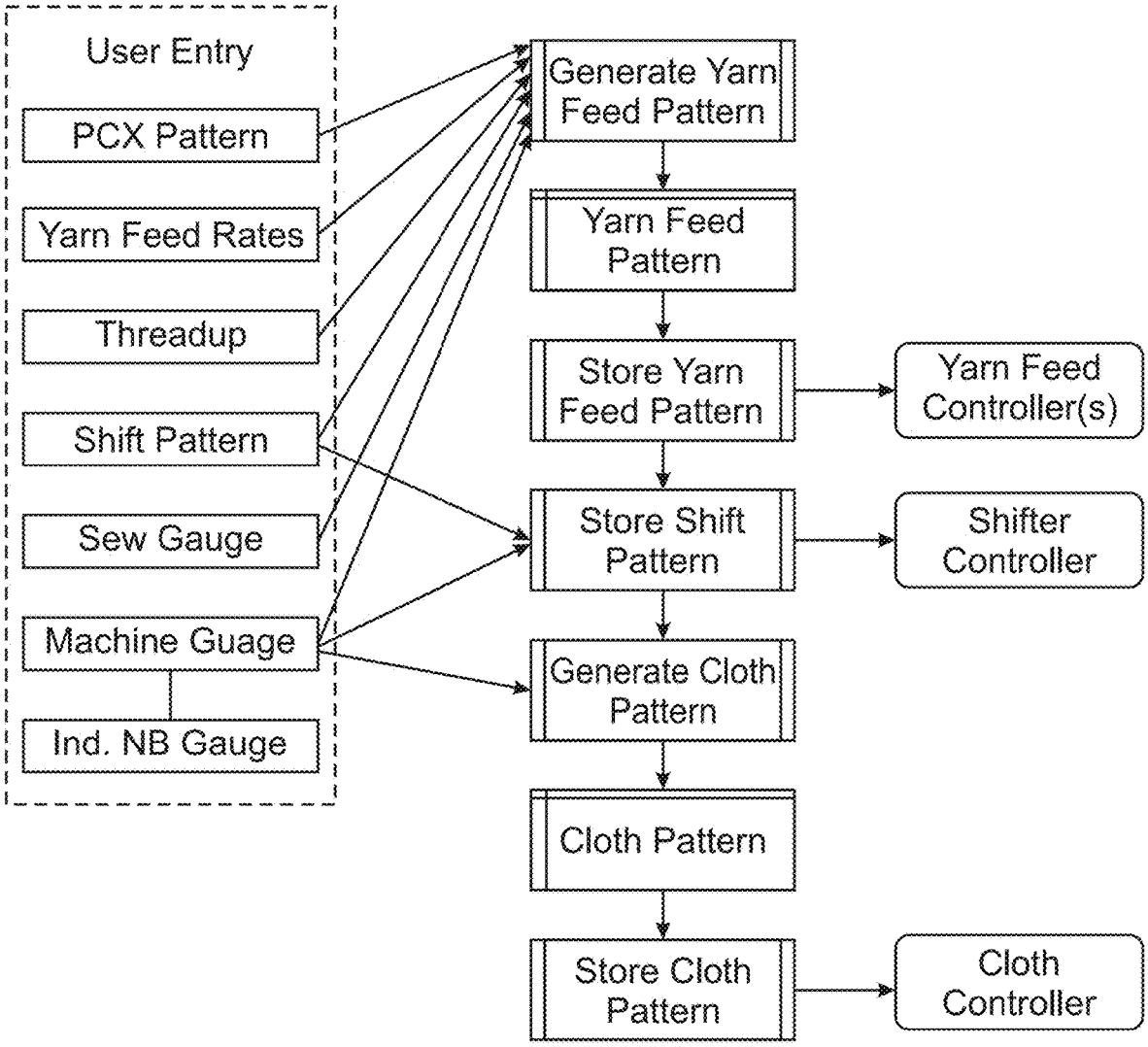
FIG. 9B is a schematic diagram illustrating the data inputs and processing to create pattern instructions for a tufting machine operable to produce variable gauge fabrics with yarn placement functionality.

FIG. 9B provides an overview of additional sew gauge data input combined with pattern file, machine configuration, and conventional operator inputs to create pattern information files for rescaled or variable gauge patterns.

Figure 10:
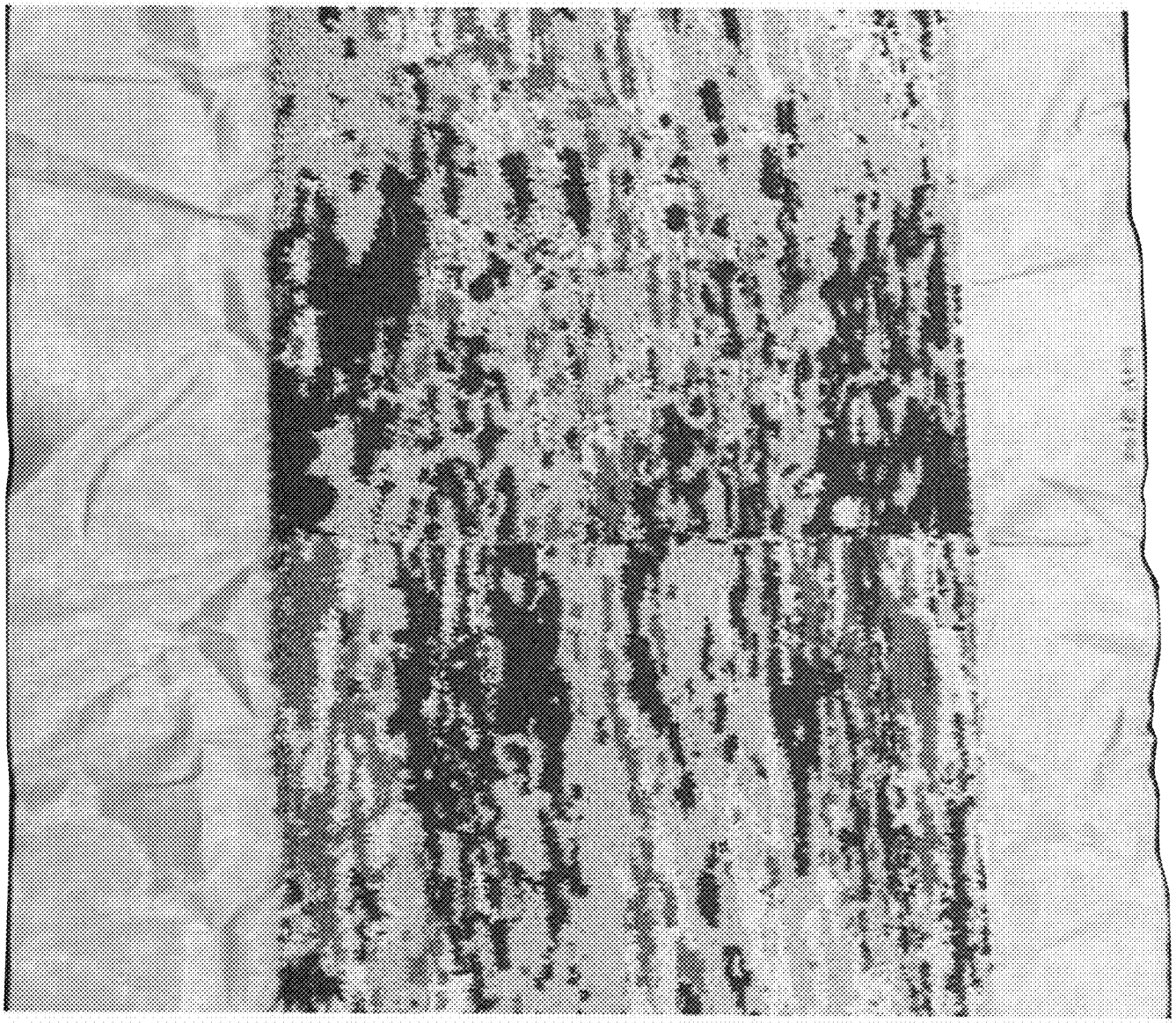
FIG. 10 is a photograph of a tufted fabric a tufting machine operable to produce variable gauge fabrics with yarn placement functionality where the pattern has been tufted at two different gauges.

As shown in FIG. 10, a single pattern can be tufted at different gauges on the same tufting machine. The machine used was a two-needlebar machine, each needle bar having a $\frac{1}{5}^{th}$ inch gauge and being offset from one another by a half gauge to create a composite $\frac{1}{10}^{th}$ gauge machine. The right side is tufted at an effective $\frac{1}{12}^{th}$ gauge and an effective 10 stitches per inch rate. The left side is also tufted ant an effective 10 stitches per inch, but is tufted at the natural $\frac{1}{10}^{th}$ gauge of the machine. The resulting weight of the $\frac{1}{12}^{th}$ gauge fabric is 38 ounces, while the weight of the $10^{th}$ gauge fabric is only 31 ounces.

Figure 11:
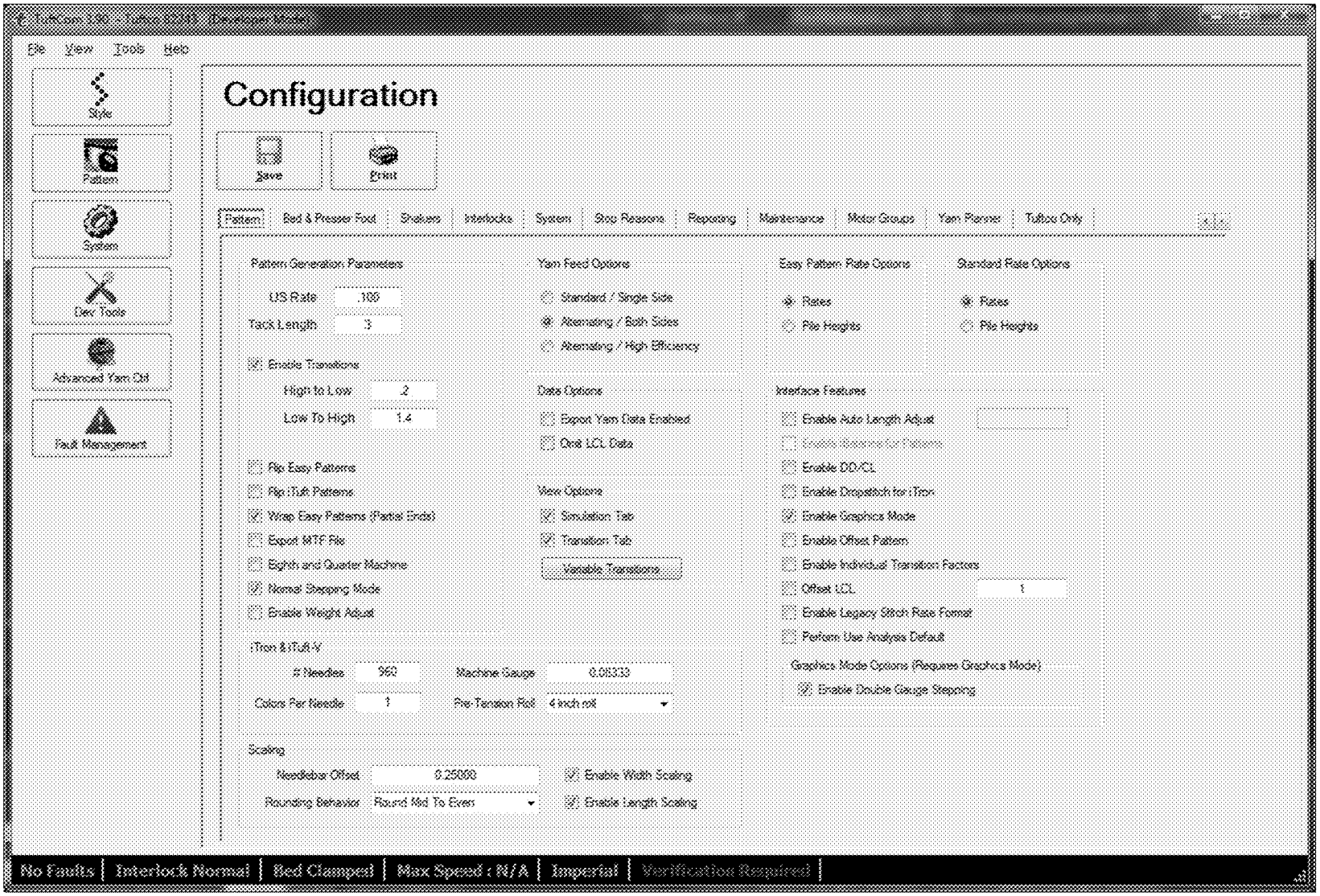
FIG. 11 is an exemplary operator screen showing a four color pattern loaded with an ABC thread-up.

FIG. 11 shows exemplary operator screen that has a four color pattern loaded with an ABC thread-up and with the tufting machine designated to run in the variable gauge backing shifting mode described in connection with FIGS. 3 through 6. It is equally possible to utilize the technique in connection with a standard tufting machine configuration that is tufting with the yarn placement techniques of U.S. Pat. Nos. 8,240,263; 9,556,549; 9,663,885 and their related families of patents. The technique is also useful in working with hollow needle tufting machines and ICN tufting machines. Essentially, the pattern can be designed with a variable gauge backing shifting or with the standard gauge needle bar shifting for the purposes of this scaling method. The technique allows the mapping of yarn placement patterns from one gauge to another.

Figure 12:
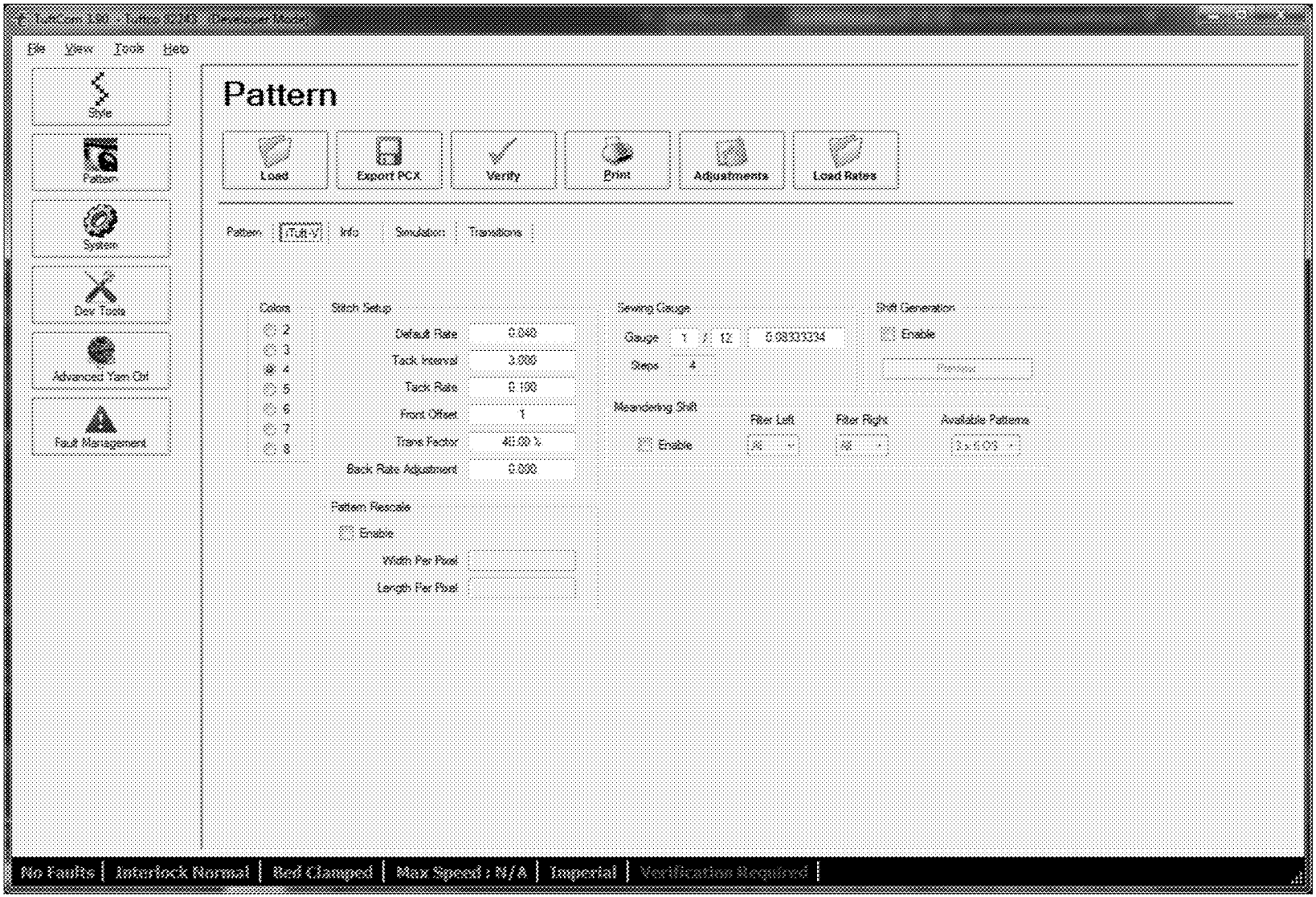
FIG. 12 is an exemplary operator screen showing pattern input screen with sewing gauge and step parameters.

FIG. 12 shows another exemplary operator screen on which the operator specifies the gauge at which the pattern is desired to be tufted. In this instance, $\frac{1}{12}$ gauge is specified. The number of steps is filled in with the number of penetrations to the next repeat in the yarn thread-up, so in the present example with a four color yarn thread-up, four steps is input. The stitch set up has a default rate entry for stitches that are left on the back of the greige, tacking interval in inches and a tack rate for the yarn feed amount to supply for a tacking stitch. The front offset is simply the row of pattern that the tufting machine will start on and the actual stitch offset can be calculated automatically by the tufting machine based upon the calculated stitch rate and the needle bar offset that is provided in the machine configuration, for example in the exemplary operator screen of FIG. 15. The transition factor adds an additional increment of yarn for stitch height increases and the amounts needed for this increase vary depending on the yarn type. A pattern rescale changes the pattern to preserve the optical integrity of the original pattern while changing the gauge or density of its stitching.

Figure 13:
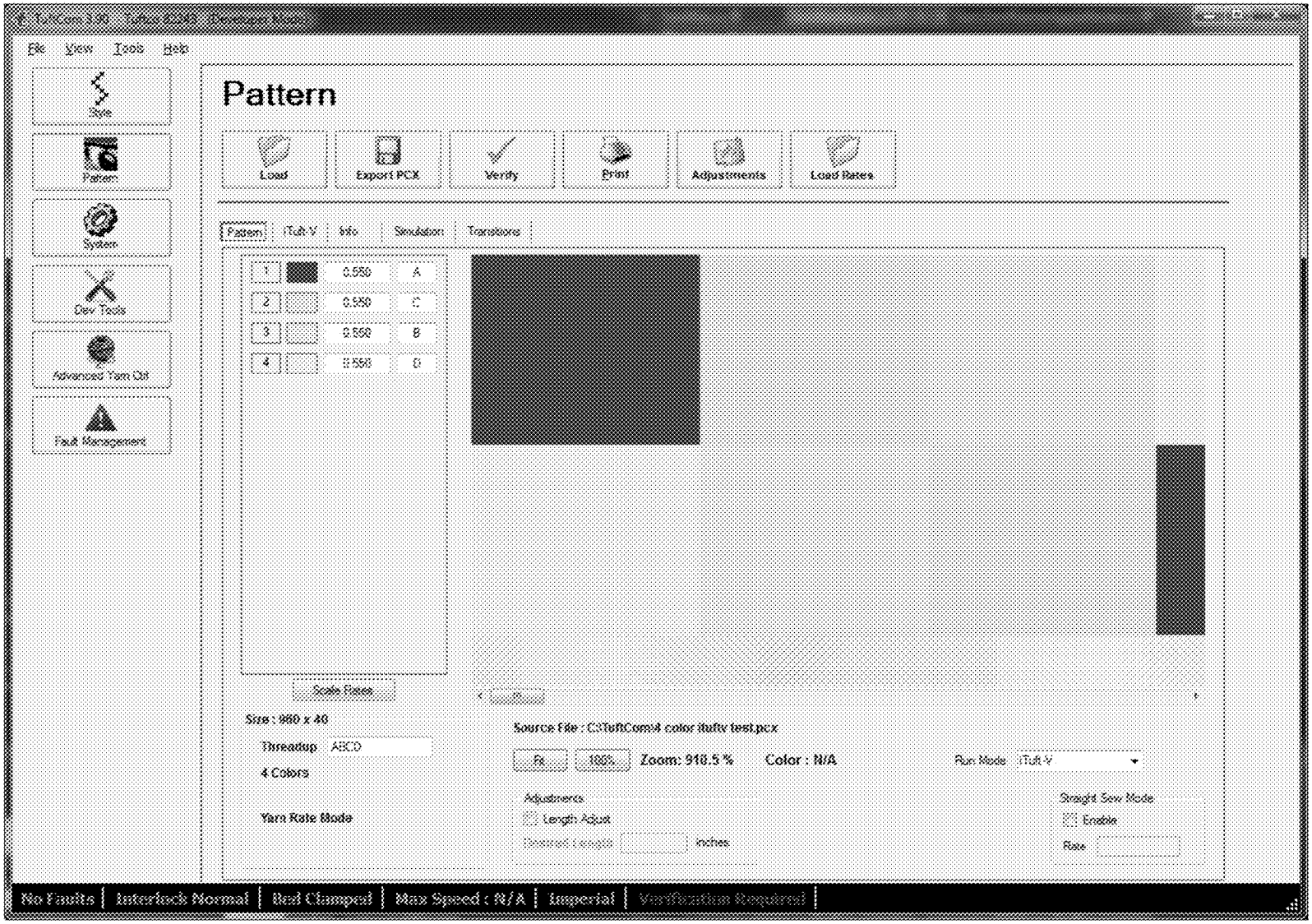
FIG. 13 is an exemplary operator screen showing stepping patterns for two needle bars and a backing shifter.

FIG. 13 is an exemplary operator screen showing how a needle bar stepping patterns can be input for front needle bar, back needle bar, both needle bars, or the cloth feed. The cloth feed shifting would be utilized on a pattern operating with the variable gauge backing shifting described in FIGS. 3-6, and also would be typical on hollow needle tufting machines. The filters tab allows for viewing of the stepping pattern of only a selected needle bar or backing shifter and the edit mode is selected for the particular lateral access that the operator will be entering the shift pattern for. The backing stitch rate is the number of stitches that appear longitudinally but in the case of four color pattern on a conventional tufting machine employing the placement technique of U.S. Pat. No. 8,141,505, actually four times as many stitches per inch are introduced into the backing with three-fourths of those stitches typically removed or tufted at imperceptibly low stitch heights.

Figure 14:
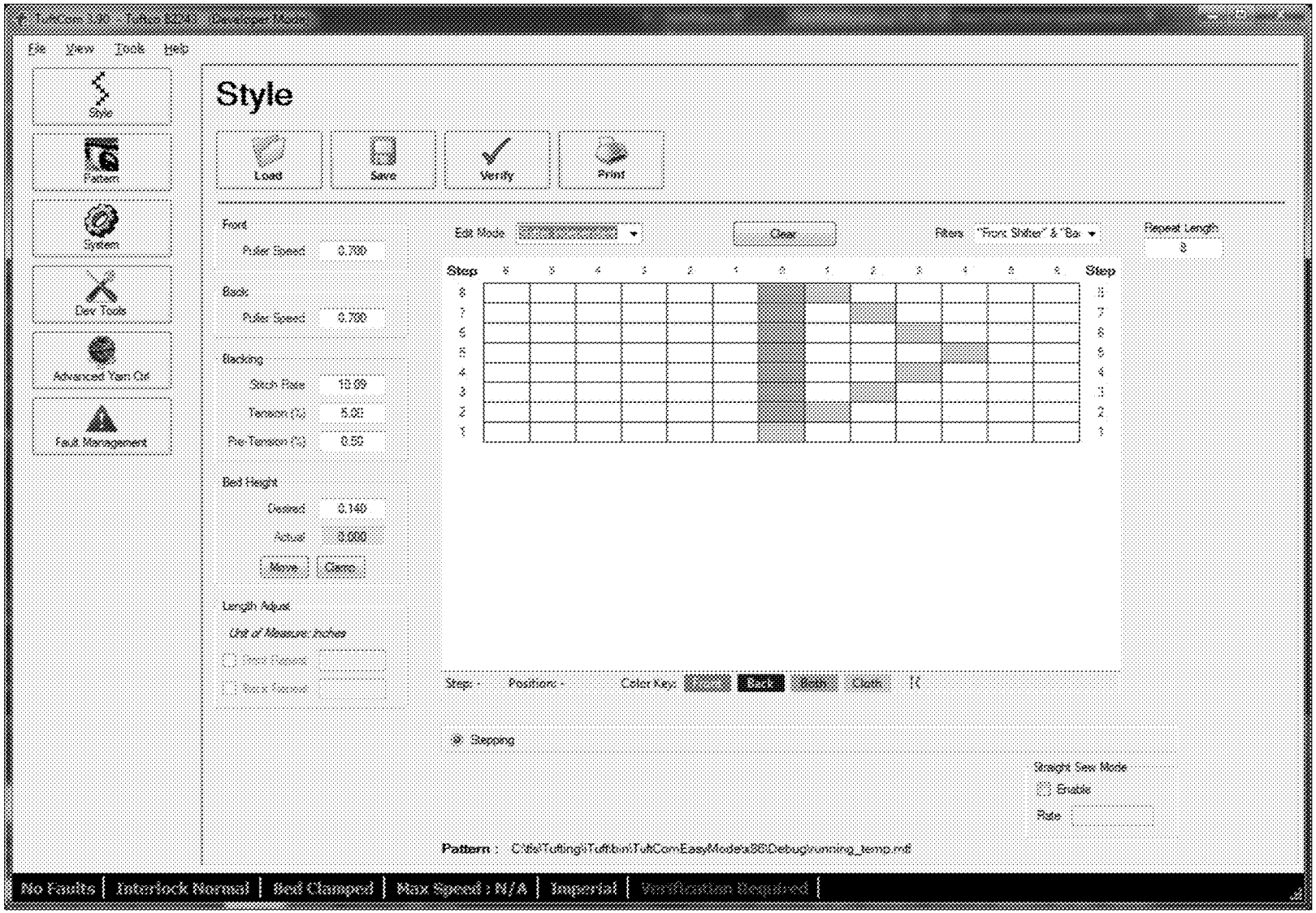
FIG. 14 is a pattern simulation screen to facilitate operator viewing of the input pattern at a stitch by stitch level.

FIG. 14 provides a pattern simulation and allows the viewing of which yarn is intended to be prominent on a particular stitch. Every penetration of the needle bar(s) is shown so that the overall length of the simulated pattern with four colors is four times its actual length. The pattern simulation provides a useful debugging tool for operator or designer.

Figure 15:
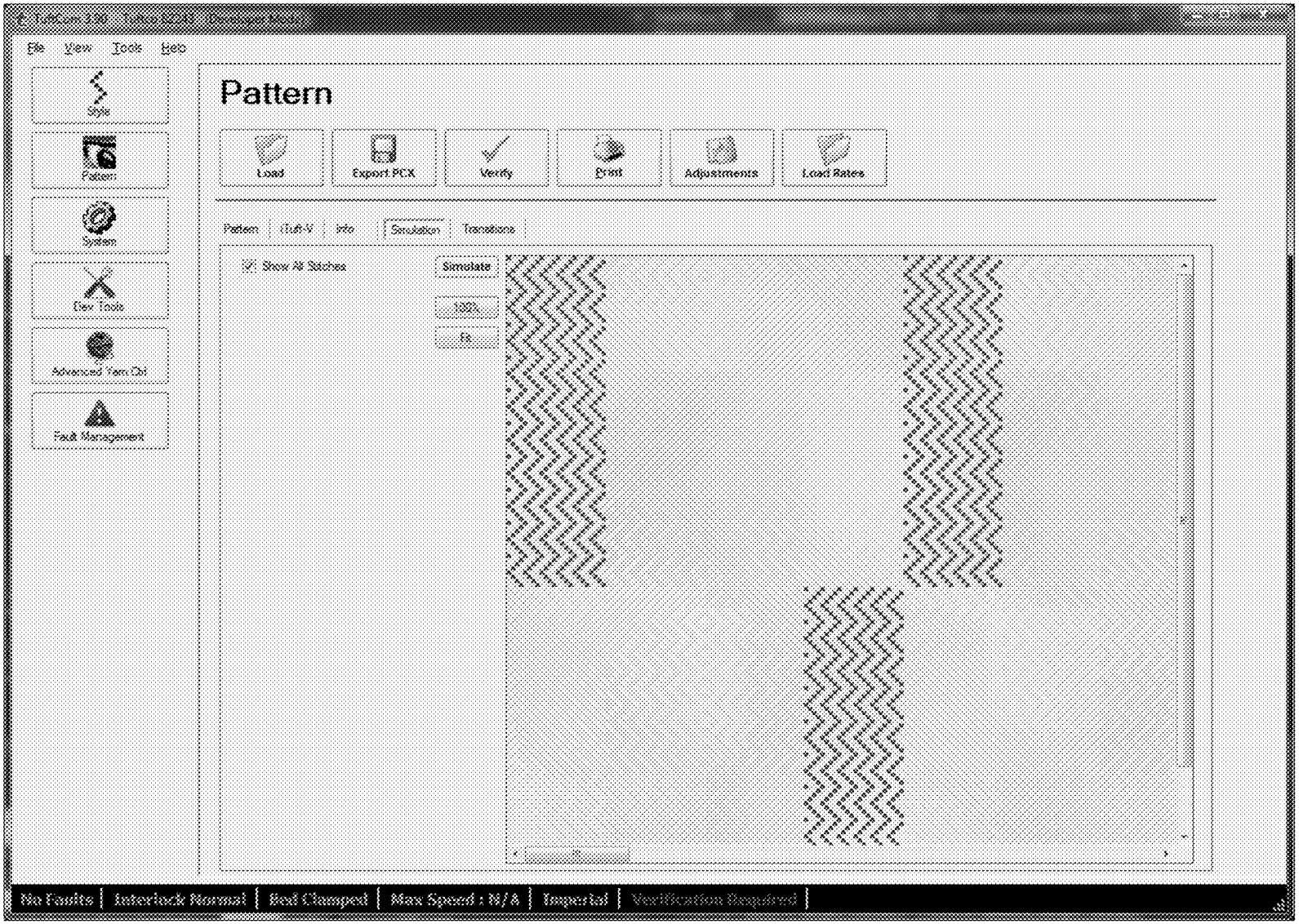
FIG. 15 is an exemplary operator configuration screen showing input of machine parameters that are utilized in calculation of pattern details.

FIG. 15 is an exemplary operator configuration page and various machine parameters such as the needle bar offset in the case of a double needle bar or staggered needle bar configuration is input. In addition, because of the rescaling algorithm, many approximations must be made to a pattern. In order to achieve the most aesthetic pattern, a variety of rounding behaviors for these approximations are desirable. The typical alternatives are round mid-to-even, round up, round down, and round mid away from zero.

Figure 16:
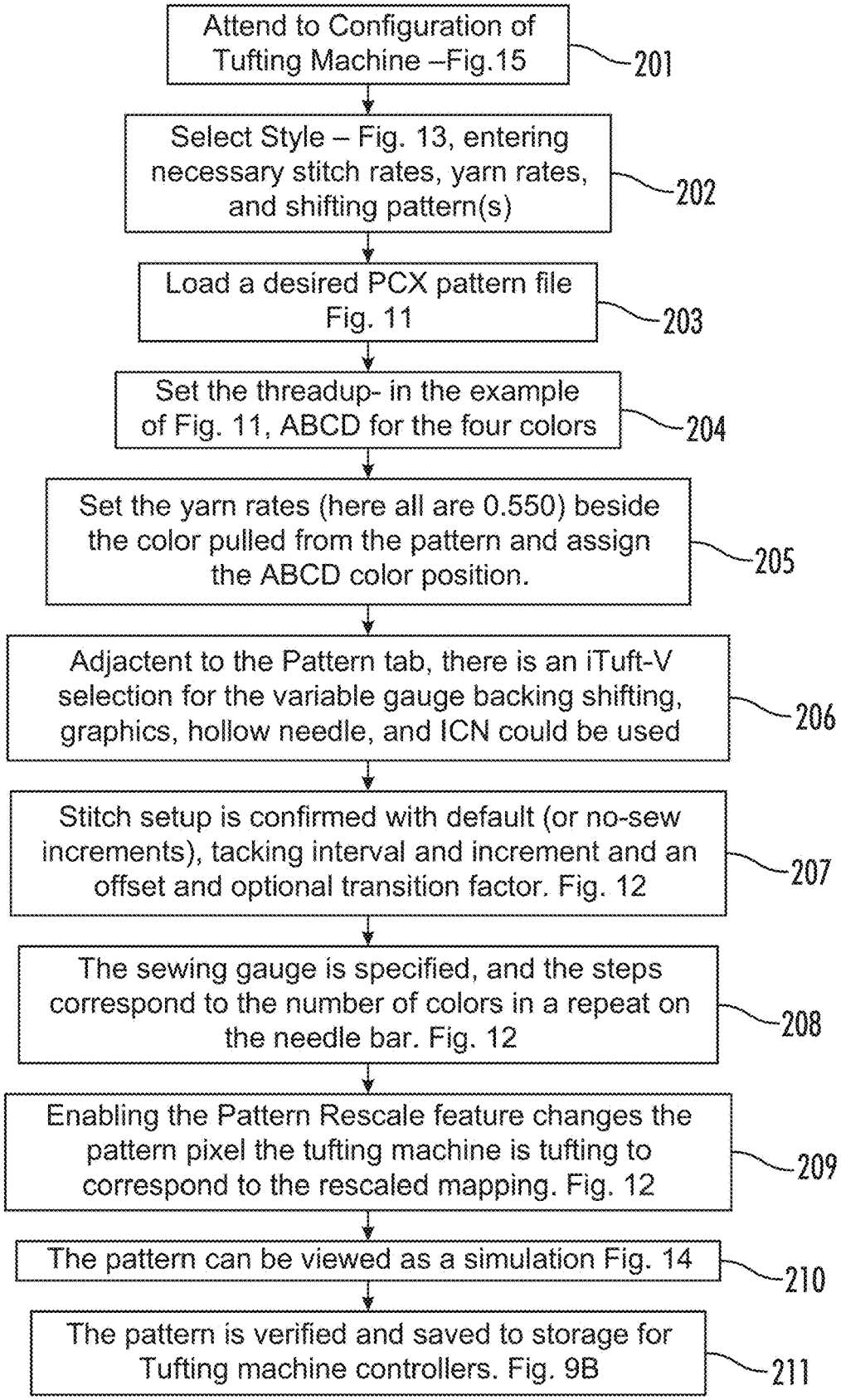
FIG. 16 is a flow chart of pattern manipulation for rescaling.

FIG. 16 provides a schematic illustration of the logic flow that is desired in scaling a pattern. Specifically, the customary preliminary steps are taken where the configuration of the tufting machine is entered into the software 201, 202. Then a bitmap pattern is loaded 203. The tufting industry presently favors the PCX file format for bitmap files because it has a limited pallet of 256 colors. Thus, the use of the PCX file format assures a limited number of yarn/pile height combinations will be included in a pattern. When the pattern is loaded, the threadup is specified for a conventional (or ICN) tufting machine, generally in an alphabetic sequence corresponding to the number of yarns, i.e. ABC for three yarns, ABCD for four yarns 204. There are necessary variations on the details of this step for hollow needle tufting machines where three or even more yarns can be carried by a single needle for selective tufting. The yarn feed rates are also set 205. There is an option for the type of tufting machine configuration. A single machine could be equipped to operate with variable gauge backing shifting or graphics (or even single) needlebar shifting. Hollow needle or ICN type machines would typically be specified in the configuration setting, as those machine types would be exclusive of other alternatives.

The particulars for stitches are confirmed, and with single or graphics needlebar yarn placement, this will typically include a yarn feed rate for stitches that are removed from the backing, a yarn feed increment for tacking stitches, and a tacking interval to insure that unused yarns remain bonded to the backing fabric. An offset is specified, which in the illustrated FIG. 12 need only specify the longitudinal row of stitches that the pattern will commence on and the software can compute the pattern offset required by spacing between needle bars based upon machine configuration information. A critical component for rescaling patterns is the specification of a sewing gauge. This sewing gauge and the number of color repeats Sewing gauge can be precisely specified for backing shifting machines as described in connection with FIGS. 3-6 and for hollow needle machines that also typically utilize backing shifting. Yarn placement practiced by standard tufting machines in single needle bar, as in U.S. Pat. No. 8,141,505 and family, or in graphics configurations, as in U.S. Pat. No. 9,663,885 and family, is rarely precisely scalable. Certainly, a fifth gauge ($1/5^{th}$ inch needle spacing) tufting machine can scale precisely to tuft at tenth gauge, however, a tenth gauge single or graphics needlebar machine cannot precisely scale to twelfth gauge—so some approximation is implemented. ICN tufting machines are also not precisely scalable apart from similar doubling of the machine gauge. The pattern rescale feature effectively maps the pattern at the size and tuft density that it was designed to the same size and a newly specified tuft density, preferably using an algorithm similar to that explained in connection with FIG. 17. Without rescaling, transitioning a tenth gauge pattern to twelfth gauge makes the size of the pattern graphics smaller.

The ability to rescale patterns is of increasing importance in a tufting industry driven to operate at maximum efficiency, and numerous applications exist for rescaled patterns. In one example, if a tufting facility has both tenth and twelfth gauge graphics tufting machines and all of the twelfth gauge machines are operating at full capacity while the tenth gauge machines are only operating for a single daily shift, there exists the possibility to rescale some twelfth gauge patterns to tenth gauge and obtain extra production. The resulting rescaled tenth gauge patterns will have the same appearance but a reduced tuft density and resulting cost. The possibility also exists to scale tenth gauge patterns to be tufted on a twelfth gauge machine in a fashion that closely approximates tenth gauge appearance and density. Thus pattern rescaling allows tufting mills to operate at higher capacity without the necessity of changing out all of a tufting machine's gauge parts and reconfiguring the machine. A tufting machine with variable backing shifting can with a fair degree of precision emulate the gauge and appearance of shifted single needle bar or graphics tufting machines of a variety of gauges.

Also, to optimize carpet costs, a fabric with the same appearance can be offered at a variety of densities that can be selected according to their intended use. So, for instance a residential use or even use in a hotel room may be entirely suitable with a lower density than carpet designed for use in a hotel lobby or hallway. Similarly, a manufacturer can offer carpet tiles of the same pattern in different densities at different price points.

FIG. 17 provides a simple example of the alternating yarn tufts for eight tufts of yarn, nominally at one-half inch gauge (two needles per inch) over four inches of carpet width. Of course, this is a wider needle gauge than used in practice but it keeps the example small. So, starting with needle position zero in the first row of stitches, the even needle positions are tufting dark and the odd needle positions are tufting light. When the pattern from the one-half inch gauge is scaled to be tufted at one-fourth inch gauge, where there was a single stitch of dark or light yarn, there are now two stitches in two adjacent needle positions.

Algorithmically, the tufting machine knows from the original pattern that the first 0.5 inch position is dark. Accordingly, at the new gauge the tufting machine calculates the physical needle position based upon the machine gauge and shift and if the needle is between 0.0 and 0.5 inches in location and carrying dark yarn, then a stitch will be tufted. So, in the example of FIG. 17, the one-fourth gauge needle zero will tuft in position zero and when it is shifted to position 1 (where it is at position 0.25). The backing feed can be determined in a similar algorithmic fashion, but is more readily adjusted proportionately to the gauge adjustment. In this instance, with two color yarn placement at half gauge, the typical backing feed would be one fourth inch per row of stitching. When changing to fourth gauge, the typical backing feed would be halved to one eighth inch per row of stitching. Similarly, needle 4 on the one-fourth gauge needle bar is physically located displaced one inch from the left of the pattern and will tuft dark yarn in the first two rows of stitches when it is between 1.0 and 1.5 inches. If needle 4 carries dark yarn and initially shifts left to a displacement of only 0.75, then it would not tuft as yarn would only be dispensed at a no sew or tacking rate.

In each case, the rescaling determines which longitudinal row of stitching is being addressed and the lateral displacement of each needle based upon physical gauge and the number of shifted steps at the specified sewing gauge. In rescaling from a tenth gauge pattern to a twelfth gauge density in a four color thread up, on a tufting machine having either a single tenth gauge needle bar or a composite tenth gauge graphics machine with two fifth gauge needle bars it will be realized that a great deal of approximation is required. So for instance in the four color thread up at tenth gauge, a pattern might be tufted with 40 longitudinal stitches per inch, with four sequential shifted stitches needed for each line of tufts in the pattern, but at twelfth gauge would adjust to 48 stitches per inch. As a result, the fifth line of tufts in the pattern would be the 21-24th reciprocations in the tenth gauge pattern, but the 25-28$^{th}$ reciprocations in the twelfth gauge pattern. In the intermediate longitudinal stitching, the alignment would be inexact and some rounding is required.

The same rounding issues occur with respect to the lateral position of the needles. The inexact position could be a result of tufting on a tenth gauge machine with only shiftable needles, or tufting on a variable backing shifting machine with a tenth gauge needle bar assembly. In either case, not all of the needles will align precisely on twelfth gauge. Instead, the lateral position of needle must be computed and mapped to the corresponding element of the tenth gauge pattern. When the tenth gauge needles on a needle shifting machine are laterally shifted four positions, or 0.4 inches, and cover four lateral pixels in a line of the pattern, they very nearly transverse the positions that are occupied by five lateral pixels in a twelfth gauge pattern. The calculation of the needle position evaluates the position of the needle at its neutral location, so the needle in the tenth position on a fifth gauge needle bar is at 2.0 inches. This is the physical machine location. Assuming the sew gauge of the needle bar is also fifth gauge, when the needle is shifted three steps to the right it will be at 2.6 inches. If the scale gauge is twelfth gauge, then the 2.6 will be divided by 1/12 and the needle will be in pixel position 31.2 of the twelfth gauge pattern. This leads to the need to determine whether this should be treated as position 31 or 32 for the purposes of tufting, and as might be expected, 31 is generally the best approximation. Even on a tufting machine with variable backing shifting, where shifting could be applied at optimal lateral increments, a problem exists tufting twelfth gauge fabric on a tenth gauge needle bar because there are only ten needles in a width where twelve stitches should be tufted. Approximation is required to produce the best fit of the physical stitch locations to the rescaled pattern.

Accordingly, after computing the physical needle location relative to the pattern a rounding mechanism is applied. The preferred rounding algorithms round fractions to the nearest integer with either mid-to-even (i.e., both 1.5 and 2.5 round to 2.0) or mid-away-from zero (i.e., 1.5 rounds to 2.0 and 2.5 rounds to 3.0). Other alternatives such as round up (i.e., both 2.2 and 2.8 round to 3.0) or round down (i.e., both 2.2 and 2.8 round to 2.0) may be desirable in some instances. Quirks of individual patterns may warrant experimentation with rounding to produce the most aesthetically suitable fit.

The result is the use of conventional pattern information together with a specified sew gauge and scale gauge to scale patterns from one stitch density to another while maintaining the optical integrity of the pattern. Rescaling in this fashion allows designers to create patterns of the size they intend, and the size will not be distorted when the pattern is adapted to a variety of tufting machines. Designs will be better realized and tufting machines may be used more adaptably by the implementation of these rescaling design techniques.

Numerous alterations of the structure herein described will suggest themselves to those skilled in the art. It will be understood that the details and arrangements of the parts that have been described and illustrated in order to explain the nature of the invention are not to be construed as any limitation of the invention. All such alterations which do not depart from the spirit of the invention are intended to be included within the scope of the appended claims.

What is claimed is:

1. A tufting machine for forming tufted fabrics of the type having:

at least one needle bar having a series of gauge spaced needles mounted transversely across a width of the tufting machine;

a yarn feed mechanism for feeding a series of yarns to said needles, the yarns being carried by said needles;

a needle drive for reciprocating the yarn carrying needles through a backing material;

backing feed rolls for feeding the backing material through a tufting zone of the tufting machine;

a shifter to move at least one of the backing material or needles laterally with respect to the other;

a series of gauge parts mounted below the tufting zone in a position to engage yarns carried by needles of said at least one needle bar as the needles are reciprocated into the backing material to form tufts of yarns in the backing material;

a control system for controlling and synchronizing the shifter, needle drive, backing feed, and needle plate reciprocation in accordance with pattern information corresponding to a fabric pattern, wherein the tufting machine is adapted to process the pattern information based upon sewing gauge information and tuft fabrics of at least first and second different gauges displaying the same fabric pattern.

2. The tufting machine of claim 1 wherein the yarn feed mechanism is a single end yarn feed.

3. The tufting machine of claim 1 wherein the needles mounted transversely across the width of the tufting machines are hollow.

4. The tufting machine of claim 1 wherein the shifter is adapted to move the backing feed rolls laterally.

5. The tufting machine of claim 1 wherein the shifter is adapted to move the needles laterally.

6. The tufting machine of claim 1 wherein the needles are independently controlled for selective penetration of the backing material.

7. The tufting machine of claim 1 wherein a first sewing gauge is specified for the fabric pattern that is greater than the gauge spacing of the needles.

8. The tufting machine of claim 1 wherein a second sewing gauge is specified for the fabric pattern that is lower than the gauge spacing of the needles.

9. A method of altering tuft density of a yarn placement pattern for a number of different yarns threaded to specified needle locations on a tufting machine having a needle gauge between laterally spaced yarn carrying needles reciprocated to penetrate a backing material, comprising the steps of inputting a bitmap pattern file for a tufting machine pattern at a first gauge;

inputting yarn feed rates, yarn threadup information sufficient to identify the number of different yarns and the threading of the different yarns to specific needle locations, and a shifting pattern;

specifying the needle gauge at which the tufting machine tufts;

specifying a second gauge for tufting the yarn placement pattern;

mapping the location of yarn carrying needles at the second gauge to the yarn placement pattern at the first gauge;

selecting yarns to tuft at the second gauge based upon said mapping.

10. The method of claim 9 wherein the the needle gauge is different from the second gauge.

11. The method of claim 10 wherein the second gauge is greater than the needle gauge.

12. The method of claim 10 wherein the second gauge is lower than the needle gauge.

13. The method of claim 9 wherein the needle gauge at which the tufting machine tufts is specified to be equal to the second gauge.

14. The method of claim 9 wherein mapping the location of yarn carrying needles computes an applicable shifted distance that is added or subtracted from a neutral location of each needle for each penetration of the backing material.

15. The method of claim 9 wherein a rounding algorithm is applied when mapping the location of yarn carrying needles.

16. The method of claim 15 wherein the rounding algorithm is a round-to-even or round-up algorithm.

17. The method of claim 15 wherein an operator selects the rounding algorithm.

* * * * *